US011203448B2

(12) United States Patent
Vetten et al.

(10) Patent No.: US 11,203,448 B2
(45) Date of Patent: Dec. 21, 2021

(54) METHOD AND DEVICE FOR FORMING PACKAGE BODIES OPEN AT ONE END FROM PACKAGE SLEEVES OPEN AT BOTH ENDS

(71) Applicants: SIG Technology AG, Neuhausen am Rheinfall (CH); Andrea Heil, Moenchengladbach (DE)

(72) Inventors: Thomas Vetten, Duesseldorf (DE); Johannes Marx, Aachen (DE); Michael Heil, Moenchengladbach (DE); Felix Breitmar, Moenchengladbach (DE); Matthias Dammers, Alsdorf (DE); Jürgen Richter, Duesseldorf (DE)

(73) Assignee: SIG Technology AG, Neuhausen am Rheinfall (CH)

( * ) Notice: Subject to any disclaimer, the term of this patent is extended or adjusted under 35 U.S.C. 154(b) by 223 days.

(21) Appl. No.: 16/090,387

(22) PCT Filed: Apr. 3, 2017

(86) PCT No.: PCT/EP2017/057837
§ 371 (c)(1),
(2) Date: Oct. 1, 2018

(87) PCT Pub. No.: WO2017/174497
PCT Pub. Date: Oct. 12, 2017

(65) Prior Publication Data

US 2019/0152628 A1 May 23, 2019

(30) Foreign Application Priority Data

Apr. 4, 2016 (DE) ..... 10 2016 106 139.5
May 31, 2016 (DE) ..... 10 2016 109 995.3

(51) Int. Cl.
*B65B 3/02* (2006.01)
*B65B 43/32* (2006.01)
(Continued)

(52) U.S. Cl.
CPC ..... *B65B 3/025* (2013.01); *B31B 50/006* (2017.08); *B31B 50/28* (2017.08); *B31B 50/322* (2017.08);
(Continued)

(58) Field of Classification Search
CPC B65B 3/025; B65B 7/16; B65B 41/06; B65B 43/145; B65B 43/26; B65B 43/325;
(Continued)

(56) References Cited

U.S. PATENT DOCUMENTS 2,541,607 A * 2/1951 Piazze ..... B31B 50/00 493/314
3,187,646 A * 6/1965 Monroe ..... B65B 3/025 493/164
(Continued)

FOREIGN PATENT DOCUMENTS

DE 1063890 8/1959
EP 0364140 A1 4/1990
(Continued)

*Primary Examiner* — Thanh K Truong
*Assistant Examiner* — Scott A Howell
(74) *Attorney, Agent, or Firm* — The Webb Law Firm

(57) ABSTRACT

The invention relates to a method for forming package bodies open at one end from package sleeves open at both ends for the manufacture of filled packages. In order to allow packages with a cross section which is neither square nor rectangular to be formed more simply and reliably, the package sleeves are kept ready for further processing in a stack, folded flat along at least two folded edges running in the longitudinal direction of the package sleeve, the flat-folded package sleeves are transferred in succession from
(Continued)

the stack to a forming station, the package sleeves are unfolded in a forming station and the unfolded package sleeves are, in the forming station, pushed onto a mandrel in order to close, in particular seal, a longitudinal end of the package sleeve.

20 Claims, 13 Drawing Sheets

(51) Int. Cl.

| | |
|---|---|
| ***B65B 43/50*** | (2006.01) |
| ***B65B 7/16*** | (2006.01) |
| ***B65B 61/24*** | (2006.01) |
| ***B65B 43/14*** | (2006.01) |
| ***B65B 55/10*** | (2006.01) |
| ***B31B 50/28*** | (2017.01) |
| ***B31B 50/78*** | (2017.01) |
| ***B31B 50/00*** | (2017.01) |
| ***B31B 50/32*** | (2017.01) |
| ***B65B 43/54*** | (2006.01) |
| ***B65B 41/06*** | (2006.01) |
| ***B65B 43/26*** | (2006.01) |
| *B31B 105/00* | (2017.01) |
| *B31B 100/00* | (2017.01) |

(52) U.S. Cl.
CPC ..... *B31B 50/782* (2017.08); *B31B 50/788* (2017.08); *B65B 7/16* (2013.01); *B65B 41/06* (2013.01); *B65B 43/145* (2013.01); *B65B 43/26* (2013.01); *B65B 43/325* (2013.01); *B65B 43/50* (2013.01); *B65B 43/54* (2013.01); *B65B 55/10* (2013.01); *B65B 61/24* (2013.01); *B31B 2100/0022* (2017.08); *B31B 2105/0022* (2017.08)

(58) Field of Classification Search
CPC ..... B65B 43/50; B65B 43/54; B65B 55/10; B65B 61/24; B31B 50/788; B31B 50/006; B31B 50/782; B31B 50/28; B31B 50/322; B31B 2100/0022
See application file for complete search history.

(56) References Cited

U.S. PATENT DOCUMENTS

| | | | | |
|---|---|---|---|---|
| 3,533,333 | A * | 10/1970 | McIntyre | B31B 50/00 493/30 |
| 3,750,931 | A * | 8/1973 | Dick | B65D 5/0227 229/132 |
| 3,896,711 | A * | 7/1975 | Vuilleumier | B31B 50/00 493/314 |
| 4,510,732 | A | 4/1985 | Lothman | |
| 4,895,193 | A | 1/1990 | Rangwala et al. | |
| 4,983,154 | A * | 1/1991 | Nagahashi | B31B 50/00 493/310 |
| 5,176,608 | A * | 1/1993 | Wakabayashi | B65B 43/185 493/125 |
| 5,382,217 | A | 1/1995 | Namowitz | |
| 5,536,231 | A * | 7/1996 | Nilsson | B31B 50/00 493/315 |
| 6,699,165 | B1 * | 3/2004 | Krieger | B65B 43/325 493/122 |
| 9,475,595 | B2 | 10/2016 | Paradisi et al. | |
| 10,011,379 | B2 * | 7/2018 | Baltes | B65B 43/185 |
| 2009/0193763 | A1 | 8/2009 | Fontanazzi et al. | |
| 2012/0240528 | A1 * | 9/2012 | McCracken | B31B 50/00 53/492 |
| 2014/0260119 | A1 * | 9/2014 | Baltes | B65B 43/285 53/492 |
| 2015/0068163 | A1 * | 3/2015 | Baltes | B65B 43/24 53/492 |
| 2016/0159004 | A1 * | 6/2016 | Poell | B29C 66/1122 229/5.8 |

FOREIGN PATENT DOCUMENTS

| | | | |
|---|---|---|---|
| EP | 1826126 | A1 | 8/2007 |
| JP | S55150713 | U | 10/1980 |
| JP | H06198771 | A | 7/1994 |
| JP | 2002255117 | A | 9/2002 |
| JP | 2014500207 | A | 1/2014 |
| WO | 9616789 | A1 | 6/1996 |
| WO | 2007071698 | A1 | 6/2007 |

* cited by examiner

METHOD AND DEVICE FOR FORMING PACKAGE BODIES OPEN AT ONE END FROM PACKAGE SLEEVES OPEN AT BOTH ENDS

CROSS REFERENCE TO RELATED APPLICATIONS

This application is the United States national phase of International Application No. PCT/EP2017/057837 filed Apr. 3, 2017, and claims priority to German Patent Application Nos. 10 2016 106 139.5 and 10 2016 109 995.3 filed Apr. 4, 2016, and May 31, 2016, respectively, the disclosures of which are hereby incorporated in their entirety by reference.

BACKGROUND OF THE INVENTION

Field of the Invention

The invention relates to a method for forming package bodies open at one end from package sleeves open at both ends for the manufacture of filled packages, wherein the package sleeves are kept ready for further processing in a package stack, folded flat along at least two folded edges running in the longitudinal direction of the package sleeves. The invention further relates to a device for forming package bodies open at one end from package sleeves open at both ends for the manufacture of filled packages, with a magazine comprising a package stack formed of package sleeves, wherein the package sleeves in the package stack are folded flat along at least two folded edges running in the longitudinal direction of the package sleeves. Description of Related Art Methods and devices for forming package bodies open at one end from package sleeves open at both ends have already been known for some time. The methods are used in particular to manufacture filled packages, whereby methods and devices for filling packages with products of various kinds are known.

SUMMARY OF THE INVENTION

In this context, package bodies are understood to mean for example composite paperboard packages which are at least partially formed from a package material in the form of a laminate comprising a paperboard layer and outer plastic, in particular thermoplastic, layers, of polyethylene (PE) for example. The paperboard makes the packages sufficiently stable for them to be handled easily and for example stacked. The plastic layers protect the paperboard against moisture and the foodstuffs against absorbing undesirable substances from the package. In addition, further layers, for example an aluminium layer, can be provided which prevent a diffusion of oxygen and other gases through the package material.

Corresponding package bodies are typically filled with products in the form of foodstuffs, in particular beverages, possible products primarily being flowable products. In particular, the package bodies are filled with foodstuffs in a sterile or aseptic environment of a filling machine, since the foodstuffs need to stay fresh for a long time after the packages are filled. For this purpose, the filling machines have for example sterilisation rooms or aseptic chambers in which the package bodies are sterilised and then filled and sealed under as far as possible sterile conditions. Following the filling of the package bodies, these are typically sealed in the filling machine. Where corresponding package materials are used, the package body is closed by sealing the open end.

The package bodies are preferably formed on the filling machine from package sleeves which are in turn manufactured from sleeve blanks of package material, in particular by sealing together the longitudinal edges of the package material sleeve blanks. The inner longitudinal edge can thereby be folded over to the outside in order to prevent the penetration of moisture into the package material, in particular the paperboard. In this way, package sleeves formed from a package material which are open at the opposite longitudinal ends are produced. The package sleeves are prefolded along four fold lines running longitudinally to the package sleeve, as a result of which folded edges are created which form the later edges of the package, which typically has a square or rectangular cross section. First, however, the package sleeves are folded flat along two opposite folded edges. Two of the prefolded fold lines are thereby folded back again. The package sleeve then substantially forms two portions lying parallel to one another and on top of one another. The flat-folded package sleeves are transferred to a magazine of the filling machine as a stack. The front portion of the package sleeve at the front end of the stack is seized by suction cups and pulled away from the stack, whereby the package sleeve opens up, typically until an at least substantially square or rectangular cross section is formed. This unfolding takes place along the prefolded fold lines, two of which have formed the folded edges of the collapsed package sleeves, since the package material can be gently bent or folded along the, in particular prefolded, fold lines. The opened package sleeve is then drawn onto a mandrel of a so-called mandrel wheel, the cross section of the mandrel corresponding to the cross section of the package sleeve. The package sleeve thereby initially projects outwards beyond the mandrel, so that the projecting part of the package sleeve can be folded against the end face of the mandrel and pressed and sealed there. In this way the corresponding longitudinal end of the package sleeve is closed and as a rule forms the base of the later filled package. Alternatively however, the closed end of the package sleeve could also form the top of the later package, if for example this is filled through the open base.

The package bodies open at one end are conveyed into a sterilisation zone of the filling machine. In most case this takes place in that the package bodies are transferred in succession into cells of a transport device which receive the package bodies. The transport device then ensures that the package bodies are transported through the sterilisation zone of the filling machine with a defined speed and at a defined distance from one another. In the sterilisation zone, the package bodies are preheated with hot sterile air and then sterilised, typically with hydrogen peroxide, and dried with sterile air. The sterile package bodies are transferred to the filling and sealing zone where they are filled. The opening of the filled package bodies is then closed before the closed package is transported by the transport device from the filling and sealing zone and then removed from the corresponding cells of the transport device.

In some filling machines, the package bodies are transported in a straight line through the filling machine by the transport device. Corresponding filling machines are also known as linear machines. In other filling devices, so-called carousels, the package bodies describe a more or less arc-formed movement which can consist of one or more circular arc segments. The present invention fundamentally relates to both types of filling machines.

The method and device of the type described above have proved practical for the manufacture of packages with at least substantially rectangular or square cross sections. However, the manufacture of packages with significantly different cross sections is only possible to a limited extent, or not at all. In order to take up less space, the package sleeves need to be folded flat and then formed simply and reliably by means of the mandrel wheel. Moreover, the form of the packages must allow the package sleeves to be placed readily on the mandrel wheel and must allow the package bodies to be removed again from the mandrel wheel reliably.

The present invention is based on the problem of configuring and further developing the method and the device of the aforementioned type such that packages with a cross section which is neither square nor rectangular can be formed simply and reliably.

According to claim 1 this problem is solved through a method for forming package bodies open at one end from package sleeves open at both ends for the manufacture of filled packages

- wherein the package sleeves are kept ready for further processing in a package stack, folded flat along at least two folded edges running in the longitudinal direction of the package sleeve,
- wherein the flat-folded package sleeves are transferred in succession from a package stack to a forming station and
- wherein the package sleeves are unfolded in a forming station,
- wherein the unfolded package sleeves are pushed from the forming station onto a mandrel in order to close, in particular seal, a longitudinal end of the package sleeve.

The above problem is also solved by means of a device according to the preamble of claim 12 in that a transfer device for transferring the package sleeves of the package stack in succession to a forming station for unfolding the package sleeves and a placement device for pushing the package sleeves which have been unfolded in the forming station onto a mandrel.

It has thus been recognised that it can be expedient not to unfold the package sleeves when removing them from the package stack and transferring them directly to the mandrels of a mandrel wheel but to use a separate forming station for the unfolding of the package sleeves. In order to allow the package sleeves to be readily unfolded on being removed from the stack this requires four prefolded fold lines. If the front side of the package sleeve on the front end of the package stack is seized, for example by a gripper arm equipped with suction cups, and pulled off the stack, the package sleeve unfolds, whereby the folded edges form the edges of the unfolded package sleeve. This is a proven method; however, the folded edges play a not insignificant part in determining the cross-sectional form of the package sleeve.

In contrast, the use of the forming station permits the use of package sleeves with, if required, only two folded edges, which allow the package sleeve to be folded flat in order to be formed into a stack. In addition however, the two folded edges do not need to determine the form, in particular the cross section, of the later package. In the forming station, the package sleeve can be brought into the desired form without the folded edges needing to be arranged in corners of the package or on edges of the sleeve of the package. The folded edges can for example be arranged in flat portions of the sleeve of the package so that the edges of the sleeve of the package can be formed independently of the position of the folded edges or so that sharp edges can be avoided, in part or if necessary wholly. In this way, the edge regions of the sleeves of the packages can be formed in the forming station with a very large radius and, alternatively or additionally, curved side walls of the sleeve of the package can also be formed more simply.

In order to ensure that the folding of the package sleeve along the at least two folded edges to form a flat package sleeve takes place simply and reliably, so-called fold lines are first provided along the folded edges. The package sleeve thereby preferably has further fold lines or crease lines which for example serve the purpose of folding the longitudinal ends of the package sleeve for the purpose of closing the package sleeve. A top and a base of the package are thereby preferably formed by folding along the further fold lines, which are in particular sealed. The fold lines or crease lines are thereby preferably impressed into the package material, in particular through so-called creasing, for which reason the fold lines produced in this way can also be referred to as crease lines. The fold lines or crease lines are created through a linear material displacement using tools which press against the package material, for example stamping or pressing tools. In other words, the fold lines or crease lines form linear material weakenings in the package material. The bendability of the package material is increased along the fold lines created in this way.

Independently of the number of folded edges of the package sleeve, although exactly two folded edges are preferred, it is possible to dispense completely with corresponding fold lines running between the folded edges which extend in a straight line in a longitudinal direction, i.e. at least substantially parallel to the folded edges, over the entire longitudinal extension of the package sleeve. This results in a greater flexibility in choosing the form of the package. Due to the use of a forming station to unfold the package sleeve following removal from the package stack, further fold lines and folded edges running in a straight line are not necessary. Preferably, no further prefolded fold lines of the package sleeve are provided in addition to the folded edges, in any case no fold lines which run in a straight line over the entire longitudinal extension of the package sleeve. The prefolding of corresponding fold lines, that is to say, in particular, folding the package material along the fold lines prior to the actual folding of the fold lines and then folding them back, takes place in known methods prior to stacking of the package sleeves, so that the package sleeves unfold along the prefolded fold lines more easily following removal from the stack. This is not necessary in the present case due to the forming station and the unfolding of the package sleeves therein. If, therefore, fold lines running continuously in a straight line in the longitudinal direction of the package sleeve are to be provided in addition to the folded edges, which is fundamentally optional, these are preferably not prefolded.

Fundamentally however, no further fold lines are required in order to create corresponding folds in the package sleeve. Since folds or bends in the package material can occur on fold lines and/or folded edges of the finished package, as a result of the reduction in the number of fold lines and/or folded edges, broader areas of the package can be created without undesired bends or folds, which is preferable in some circumstances. For example, the packages can be identically convex, rounded and/or curved in these areas, without this form being affected by bends or folds.

Preferably, the at least two fold lines or crease lines which allow the package sleeve to be folded flat and which accordingly form the at least two folded edges of the package sleeve are so-called "apparent fold lines" which do not later form an edge of the packaging or package. A folding along the apparent fold lines therefore only takes place in order to form the package sleeve, not however in the packaging produced from this, which together with the filling can form the package. These apparent fold lines are intended—like conventional fold lines—to facilitate the folding of the package sleeve. These fold lines are referred to as "apparent fold lines", since these are only used when folding the package sleeve flat, but lie at least roughly straight again when unfolding the package sleeve in order to produce the package body or the package which is to be filled. They can be created through material weakenings, whereby in order to maintain the liquid-tight state of the composite material, perforations are not used, but so-called "creases". Creases are linear material displacements which are impressed or rolled into the composite material by means of stamping or pressing tools. The two apparent fold lines are straight and run parallel to one another. The package sleeve is folded along the at least two apparent fold lines, which thus form the folded edges.

However, further fold lines can also be provided. In particular however, these are ones which do not extend in a straight line, or only do so over a part of the longitudinal extension of the package sleeve. These can form correspondingly formed edges which for example make it easier to hold and grip the later package. This too provides increased flexibility in choosing the form of the package, without nonetheless needing to adhere to the known four preformed fold lines for the purpose of unfolding the package sleeve.

In particular, the use of a package sleeve according to the patent applications submitted today in parallel by the applicant under the applicant's file references 152605DE, 160476DE and 160669DE, which are herewith also made the subject matter of the present patent application by way of reference, is preferred. The packages described in more detail in the patent applications are for example also thereby formed. The use of the sleeve blanks and package materials described in the patent applications is also preferred in the present case.

The transfer device can for example be designed as a gripper arm or can include a gripper arm. Alternatively or additionally, the transfer device can comprise at least one finger which can be placed in contact with a package sleeve and thus displace the package sleeve.

However, other known transfer devices are also conceivable. The placement device can thus comprise at least one finger for grasping the edge of the package and slipping the package sleeve over the mandrel. However, the package sleeve can also be transferred directly from a mould used for unfolding the package sleeve onto the mandrel, so that the placement device can be designed for corresponding movement of the mould over the mandrel. However, other known placement devices are also conceivable.

In order to facilitate understanding and in order to avoid unnecessary repetition, the method and the device are described together in the following, without in each case making a distinction between the method and the device. However, it will be clear to the skilled person, from the context, which features are in each case preferred for the method and for the device.

In a first particularly preferred embodiment of the method, the package sleeves are folded flat along exactly two folded edges. This makes it possible to store the package sleeves in a stack, so as to save space. Also, in this case the package sleeves only need to be folded along two folded edges. Preferably, the two fold lines used to form the folded edges are "apparent fold lines" of the kind described above, which thus do not later form an edge of the packaging or package. A folding along the apparent fold lines therefore only takes place in the case of the package sleeve, but not however in the case of the packaging or package manufactured therefrom.

However, in this case too, further fold lines can be provided. In particular however, these are again ones which do not extend in a straight line, or only do so over a part of the longitudinal extension of the package sleeve. These can form correspondingly formed edges which for example make it easier to hold and grip the later package. This too provides increased flexibility in choosing the form of the package, without nonetheless needing to adhere to the known four preformed fold lines for the purpose of unfolding the package sleeve.

Alternatively or additionally, in the forming station, the at least two folded edges, in particular the exactly two folded edges, of the package sleeve along which the package sleeve was previously folded flat are moved towards one another, whereby the free cross section of the package sleeve is enlarged accordingly. In this way, an at least partial unfolding of the package sleeve is achieved simply, without this requiring more than two folded edges or more than two prefolded fold lines, as in the case of the known package sleeves. In the case of known package sleeves, four prefolded fold lines are present which facilitate the unfolding of the package sleeve following removal from the stack of package sleeves. These four prefolded fold lines thereby form the folded edges of the package sleeve. The present forming station makes such package sleeves superfluous. For the sake of simplicity, it is thereby expedient for pressure to be applied from outside against the at least two folded edges in the forming station. In this way, the folded edges can move towards one another, causing enlargement of the free cross section of the package, or can be pressed inwards in relation to the associated package sleeve. For example, pressure can be applied from opposite sides of the package sleeve against the at least two folded edges, so that these approach one another, but preferably do not come into contact with one another, since this would typically be once again associated with a reduction in the free cross section of the package sleeve.

In order to achieve a controlled and defined unfolding of a package sleeve in the forming station, the package sleeve can be positioned in the forming station between at least two mould halves of a mould. On closing the mould formed by the at least two mould halves, or at least as the at least two mould halves move towards one another, the package sleeve is unfolded. As a result of the closing of the mould halves, these press against the folded edges of the package sleeve and so bring about the unfolding of the package sleeve. The package sleeve thereby preferably lies against the inside of the mould, at least substantially circumferentially, so that the package sleeve assumes a defined form. The mould can fundamentally be formed of more parts than the two mould halves, or the mould halves may if necessary be formed of several parts. However, it is expedient if two parts together form, in particular, the greater part of the mould.

In order to unfold the initially flat-folded package sleeve, the front side of the package sleeve present at the front side of the stack of package sleeves can be grasped and moved forwards away from the stack. In this context, forwards is understood to refer to the side of the stack or of the package sleeve facing in the direction of the direction of transport. This takes into consideration the fact that the package sleeves in the stack are typically standing upright. However, it would for example also be conceivable for the flat-folded package sleeves to lie on top of one another. In this case, the upper side of the stack would in this sense be regarded as being the front side of the stack. Accordingly, the upward-facing side of the top package sleeve would form the forward-facing side of the front package sleeve. The orientation of the stack is thus not of crucial importance.

In order to allow the front side of the frontmost flat-folded package sleeve to be grasped simply and reliably, suction cups can be used for this purpose which can be mounted on a movable arm. In this way for example, but not exclusively, the front side of the package sleeve can be moved forwards with the arm. In the manner described, the package sleeve is drawn forwards, as a result of which the package sleeve can be at least partially unfolded. This allows a simple and compact handling of the package sleeves. A particularly simple and precise handling of the package sleeves is thereby possible if the package sleeves move away from the stack in a straight line, and are not for example guided along a curve or similar. However, the at least partial unfolding or prefolding of the package sleeve can also take place subsequently, if necessary in a separate method step. Irrespective of this, the package sleeve is preferably drawn or moved through a channel which is limited in a transverse direction relative to the package sleeve through boundaries, for example in the form of sliding surfaces along which the package sleeve can slide, in such a way that the folded edges along which the package sleeve was previously folded flat come to lie against the channel, in particular against boundaries of the channel facing the middle of the channel. The folded edges can then slide along the boundaries, designed for example in the form of sliding surfaces. In the direction of transport of the package sleeve, which for the sake of simplicity is preferably moved in a straight line through the channel, the channel narrows so that pressure is applied in the transverse direction of the package sleeve to the folded edges of the package sleeve in the direction of the middle of the channel. The corresponding transverse extension of the package sleeve is consequently reduced on passing through the channel, as a result of which the package sleeve is at least partially unfolded or prefolded before being, in particular completely, unfolded.

As regards the passage of the package sleeve through the channel, a simple and yet reliable at least partial unfolding of the package sleeve is achieved if, as the package sleeve is drawn through, the lateral boundaries of the channel which can provide sliding surfaces for the package sleeve are pressed against the at least two folded edges of the package sleeve in such a way that the folded edges of the package sleeve move towards one another. In this way, the channel makes possible a simple and yet defined at least partial unfolding of the package sleeve.

Additionally, grooves can be provided at the end of the channel, in relation to the transport of the package sleeve through the channel, on opposite sides of the channel into which, in particular, the fold lines of the package sleeve engage. The grooves run at least substantially perpendicular to the transport direction of the package sleeve through the channel. Accordingly, the channel is preferably somewhat wider in the region of the grooves than immediately before and, if necessary, immediately after. As a result, although the package sleeve folds together again slightly in the region of the grooves, in this way a defined transfer position and attitude is created for the package sleeves. The package sleeve can be moved out of the grooves, preferably in a controlled way, in the longitudinal direction of the grooves. However, the package sleeve can also be transported further along the grooves without the package sleeve leaving the grooves, in order in this way to be guided by the grooves. Alternatively or additionally, the package sleeve can also be transported further with the grooves. That is to say the grooves, for example the regions of the channel or the boundaries of the channel forming the grooves, can also move in the longitudinal direction of the grooves and carry the package sleeve along with this movement and transport it further. This takes place in particular in the direction of the unfolding device, in particular as far as entry into the unfolding device. If necessary, the grooves of the channel or the regions of the channel forming the grooves, following movement of same, form parts of the mould of the unfolding device. Alternatively however, the grooves can also extend from the channel of the prefolding device into the mould of the unfolding device. In order for it to be possible for the mould to be closed without any problem, the grooves should be interrupted between the prefolding device and the unfolding device, in particular between the channel and the mould. Fundamentally, in the described manner the package sleeve can be transferred simply, reliably and in a defined manner from the prefolding device to the unfolding device of the forming station.

In order to allow the package sleeve to be moved through the forming station simply, expediently and without requiring a lot of space, it is expedient if the package sleeve is moved through the prefolding device in a first direction of transport and moved to the unfolding device, in particular into the unfolding device, in a second direction of transport, wherein the first direction of transport and the second direction of transport are oriented at least substantially perpendicular to one another. A further simplification and precise control of the movement is achieved if at least the first direction of transport or at least the second direction of transport is oriented in a straight line. In this way, a complicated and imprecise guidance around curves or similar can be avoided. In particular, it is particularly preferable for the first direction of transport to be oriented in a straight line if the prefolding device contains a channel and the package sleeve can then be moved through the channel in a straight line and thus very precisely.

Quite fundamentally, a high degree of flexibility in the configuration of the package is provided if the folded edges of the package sleeve along which the package sleeve had previously been folded flat are pushed onto the mandrel at a distance from at least one edge of the surface of a mandrel and/or at least one corner of the top of the mandrel. It is thus preferably the case that no previously folded edge coincides with any of the edges of the mandrel, which preferably extend in the longitudinal direction of the mandrel. The folded edges are in this case positioned between these instead. This allows edges of the package sleeve to be provided with larger radii and entire sides of the package sleeve can be made convex without any problem and also shaped into this form on the mandrel. If necessary however, an edge or several edges of the mandrel can be provided along which a folded edge of the package sleeve is positioned. Preferably, however, this does not apply to all edges of the mandrel.

It is expedient for the formation of the package if the distance of the at least one folded edge of the package sleeve from the adjacent edge of the mandrel in one direction, as well as the distance of the at least one folded edge from the adjacent edge, in particular of the surface of the mandrel in the opposite direction in each case amounts to at least a tenth, preferably at least a fifth, in particular at least a third of the distance between the adjacent edges of the mandrel on both sides of the folded edge. Alternatively or additionally, it can be favourable for the formation of the package if the distance of the at least one folded edge of the package sleeve from the adjacent corner of the top of the mandrel in a direction transverse to the mandrel as well as the distance of the at least one folded edge from the adjacent corner of the top of the mandrel transverse to the mandrel in the opposite direction in each case amounts to at least a tenth, preferably at least a fifth, in particular at least a third of the distance between the adjacent edges of the mandrel on both sides of the folded edge. In this way the folded edges are far enough away from an edge region or corner region of the mandrel in order for example to form packages with convex or rounded portions which extend over a broad area of the sleeve of the package. However, the aforementioned distances preferably do not necessarily apply to each folded edge.

In this case, the folded edges of the package sleeve can for example readily be arranged on sides of the mandrel, in particular of the surface of the mandrel. The sides of the mandrel can thereby in particular be flat and/or bulge outwards. The folded edges are folded back accordingly until the portions of the package sleeve adjacent to the folded edges are for example arranged in a plane or form a continuous curvature, for example an arc with constant radius.

In order to allow a suitable base of the package body to be formed on the mandrel and in order that the mandrel does not limit the form of the package too much, the package sleeve can be pushed onto a mandrel which is in a starting position. Moreover, the mandrel can be brought into the starting position before the package body is removed from the mandrel in order to allow the package body to be removed simply without the mandrel thereby deforming the package body too much. In this connection it should be taken into consideration that square or rectangular bases in particular have proved expedient. These are stable and can be formed easily and reliably by folding a longitudinal end of the package sleeve against the mandrel. However, a rectangular or square form of the mandrel can be impractical if the package is supposed to have a cross-section which is, at least in sections, not square or rectangular. In order to form the base, the mandrel can then be moved out of the starting position into a pressing position which for example allows the formation of a square or rectangular base. In other words, the pressing surface of the mandrel can only be formed with the package sleeve pushed on and before closing of a longitudinal end of the package sleeve. In order to close the corresponding longitudinal end of the package sleeve, this is folded together and pressed against the pressing surface of the mandrel. The pressing surface thereby points upwards from the mandrel, i.e. it is provided up at the top of the mandrel. The corresponding pressing of the base of the package body preferably takes place with a heated base, so that on being pressed the base is welded or sealed, that is to say closed, in a liquid-tight manner. An adhesive bonding of the longitudinal end of the package sleeve would fundamentally also be conceivable, as would be the case, fundamentally, with all connections preferably created through sealing.

The formation of the pressing surface can be such that, in order to close the package sleeve, the width of the free end of the mandrel increases at a longitudinal end, at least in one direction transverse to the package sleeve and, in order to push the package sleeve onto the mandrel or remove it, is reduced in this direction. For this purpose, mandrel elements which are adjustable in at least one direction transverse to the mandrel can if necessary be provided. A drive can be provided for this purpose which is for example actuated depending on the position of the mandrel or of a mandrel wheel carrying the mandrel. Fundamentally, if necessary corresponding mandrel elements can, in addition to being adjustable at least in one direction transverse to the mandrel, also be adjustable in the longitudinal direction of the mandrel. This can simplify the adjustment if necessary and/or have a favourable effect on the available pressing surface.

The method described above can also be used as part of a method for manufacturing a filled package. In this case, the opening at the corresponding longitudinal end of the package body remaining after filling of the package body can be closed, which is in particular achieved by the longitudinal ends, which have been folded together accordingly. In particular, only the upper margins of the package sleeve are thereby folded over one another and joined with one another. In this way, or otherwise, an upper seam, in particular a sealing seam, which runs transversely to the package is first created when closing the package. The ends of the seam then project outwards in relation to the sleeve of the package and together with the adjacent portions of the package material form so-called package lugs which project outwards in relation to the sleeve of the package. The package lugs can then, for example, be folded against the outside of the sleeve of the package and there joined, in particular sealed, together with the sleeve of the package. In order to allow the package lugs to be folded in the direction of the sleeve of the package in a controlled and reproducible manner, it is expedient to press the sleeve of the package adjacent to the package lugs, in particular immediately below the package lugs, inwards in order to lay the package lugs against the sleeve of the package. Also preferably, a fold line of the package provided at that point is thereby at least partially folded or prefolded. In the case of non-cuboid package forms, the reliable folding of the lugs and thus for example the sealing of the package lugs to the sleeve of the package can otherwise be endangered. Directly or indirectly, the package lugs can then be folded over along the correspondingly prefolded fold line in order to join the package lugs with the sleeve of the package. The prefolding of the fold lines or the package lugs can take place in a gable pre-folding device which can possess two stamps for pressing together the package beneath the package lugs, which are not yet laid against the sleeve, preferably in opposite directions.

Alternatively or in addition to the method steps described above, it is also possible to bring the filled and closed package into the desired form in a moulding device, for example in the form of a so-called package crimper. The package is thereby introduced, with the sleeve portion, into an at least two-part opened mould. The mould is then closed and the sleeve of the package is then pressed into the mould, if necessary at least substantially circumferentially. In other words, the sleeve of the package is, at least in sections, pressed together or crimped from outside in the closed mould. The package is thereby shaped into the desired form, corresponding to the inner contour of the mould. It is thereby preferable if the package is thereby folded or bent along pre-treated lines. These lines are for example so-called fold lines which are in the form of crease lines. The package material is impressed along the lines, for example in that the lines are run over with a thin wheel which presses against the package material. The fold lines typically have a lesser material thickness than adjacent areas of the package material, so that the folding of the package material along the fold lines is made easier. The package also retains the form which the package assumes when the mould of the moulding device is closed following removal from the mould, preferably for a long period.

In a particularly preferred device, as described above, a forming station for forming the package sleeve is provided before the package sleeve is pushed onto the mandrel. The forming station thereby preferably has at least two stamps for the simultaneous, if necessary partial, compression and unfolding of the package. This allows the package sleeve to be brought into a form in which the package sleeve can be pushed onto the mandrel without any problem, also if the package sleeve only has two folded edges and no further, in particular prefolded, fold lines extending continuously in a straight line in the longitudinal direction of the package sleeve. Moreover, the use of the stamps is particularly expedient in an unfolding device. Upstream, a prefolding of the package sleeve can take place in a prefolding device in which the package sleeve is partially unfolded in order to be transferred, partially unfolded, to the unfolding device so that the subsequent unfolding can be carried out reliably. Preferably, the at least two stamps are designed, as at least two mould halves, such that by closing the mould the package sleeve is unfolded and comes into contact with the inner side of the mould, in particular at least substantially circumferentially. This gives the package sleeve a form which need not have a rectangular or square cross section but can nonetheless be pushed, simply and reliably, onto a mandrel, if necessary directly from the mould, if this is pushed at least partially over the mandrel together with the package sleeve. Alternatively however, the package sleeve can also be pushed out of the mould and onto the mandrel.

In particular in addition to an unfolding device as described above, the forming station or the device can include a prefolding device comprising a channel which has, in principle, already been described in connection with the partial unfolding of the package sleeve prior to transferring the package sleeve into the mould in order to unfold the package sleeve. For this purpose the package sleeve is, for example directly following removal from the stack of package sleeves in the magazine of the device, guided through the channel, at least as far as a particular point in the channel. The width of the channel thereby narrows in the transport direction of the package sleeves to a dimension which is less than the width of the flat-folded package sleeves, in particular as they are held in the magazine. The width of the channel can if necessary initially be wider than the width of the flat-folded package sleeves.

In this way it can be ensured that the package sleeves can be introduced into the channel, in the transport direction of the package sleeves, in a reliable and reproducible manner. In the regions in which the channel is narrower than the flat-folded package sleeve, the channel presses against the package sleeves, in particular against the folded edges of the package sleeves or vice versa, so that the package sleeves are partially unfolded. During the partial unfolding or prefolding of the package sleeves, the regions of the package sleeve adjacent to the folded edges are unfolded to an angle of greater than 10°, in particular greater than 20°. Since the prefolding is also followed by an unfolding, for the sake of simplicity it can, alternatively or additionally, be preferable if the package sleeve is only unfolded along the folded edges to a maximum of 70°, a maximum of 55° or a maximum of 45°. Alternatively or additionally, the width of the package sleeve in the prefolding device can be reduced to a value of less than 95%, preferably of less than 90%, in particular of less than 85% of the width of the flat-folded package sleeve.

The channel can also possess lateral boundaries which limit the transverse extension of the channel for the package sleeves. As the package sleeve moves through the channel, the lateral boundaries come into contact with the folded edges of the package sleeve. As a result of the narrowing of the channel, the boundaries, which can form sliding surfaces along which the package sleeve can slide, press against the folded edges. This has the effect that during transport through the channel the folded edges increasingly move towards one another and consequently the package sleeves at least partially unfold.

It is particularly preferable if the boundaries of the channel are fixed in place, in any case when the package sleeve moves through. This reduces the number of movable parts, which improves the reliability of the prefolding and reduces the amount of equipment required. As a result, a high processing speed can also be safely specified, for example by means of a control device.

The prefolding device described here can fundamentally also be designed as an unfolding device through which the package sleeves are completely unfolded, or at least so far that the package sleeves can be pushed directly onto the mandrel. In this case the channel fundamentally narrows further than in the case where the channel simply serves the purpose of prefolding. In this case the cross section of the package sleeve can if necessary at least substantially be identical to the cross section of the sleeve of the later package. When unfolding the package sleeve, the regions of the package sleeve adjacent to the folded edges, in particular otherwise than during the prefolding and/or irrespective of the manner of unfolding, are unfolded to an angle of at least 160°, preferably at least 170°. For the sake of simplicity, and in order to achieve suitable forms of the package it can, alternatively or additionally, be preferable if the package sleeve is, during unfolding, unfolded along the folded edges to a maximum of 200°, preferably a maximum of 190°. The unfolding can thereby fundamentally take place independently of the circumference of the prefolding of the package sleeve. Alternatively or additionally, the width of the package sleeve in the unfolding device can be reduced to a value of less than 75%, preferably less than 70%, in particular less than 65% of the width of the flat-folded package sleeve. However, in order to limit the folding, it can be the case that the width is not reduced further than to a value of less than 65%, preferably less than 55%, in particular less than 45%, of the width of the flat-folded package sleeve.

At one end of the channel, opposing grooves can be provided to receive the folded edges of the package sleeve. The end of the channel is thereby not necessarily defined by its physical dimension, but can also be understood as the active part of the physical channel. According to this understanding, the channel extends as far as the package sleeves are transported through the channel in the direction of transport. As a result of the groove, a defined position is provided for the transfer and final unfolding of the package sleeves, as a result of which the package sleeves can be completely unfolded in a simple and reliable manner.

Furthermore, it is preferable to provide a feed device to feed the package sleeves from the prefolding device to the unfolding device of the forming station in longitudinal extension of the grooves. The feed device can for example comprise at least one movable and driven finger which presses the package sleeves, along the grooves and/or in the longitudinal direction of the grooves, out of the grooves and for example into the unfolding device, in particular into the mould in order to unfold the package sleeve. In order to exploit the fact that the package sleeve is held reliably in the grooves and in order to improve the transfer of the package sleeve, the grooves can also be moved further together with the package sleeve held between the grooves. The package sleeve can thereby be transferred to an unfolding device. The package sleeve can also be moved into the unfolding device with the grooves. A moulding of the package can for example take place here, whereby in this case the grooves can be moved towards one another within a corresponding mould as the mould closes and in this way open the package sleeve wider. This takes place in particular in that the grooves press against the folded edges which are held in the grooves. The grooves thereby approach one another, which consequently also applies to the folded edges.

A transfer device of simple construction which makes possible a space-saving handling of the package sleeve can move the package sleeve through the prefolding device, initially in a first direction of transport, in particular, for the sake of simplicity, in a straight line, and then move the package sleeve in a second direction of transport oriented substantially perpendicular to the first direction of transport into, preferably actually through, the unfolding device. It has thereby proved preferable if the transfer device comprises a gripper arm and a feed device. The gripper arm is particularly expedient for the transport of the package sleeve through the prefolding device, while the feed device, which preferably has at least one finger, is expedient for the transport from the prefolding device into the unfolding device. The gripper arm can simply grip one side of the package sleeve, in particular if the gripper arm is equipped with suction cups. A finger or similar can be used simply to press against an edge of the package sleeve in order for example to push this forward.

Alternatively or additionally, in order to manufacture packages with a design which departs significantly from a cuboid form, a mandrel or, in the case of a mandrel wheel, a plurality of mandrels are used which can be adjusted between a starting position and a pressing position. In particular, a top of a mandrel, that is to say the mandrel head, can be adjusted in this manner. In the pressing position, the mandrel forms a pressing surface for pressing the corresponding longitudinal end of the package sleeve against the mandrel in order for example to seal the base of the package body and thus close it in a liquid-tight manner. It is thereby expedient, in particular, to adjust the mandrel between a narrow starting position in which a package sleeve can be pushed on and, if necessary, in which the package body can be removed, and a wider pressing position. The change in width can thereby only take place in one direction transverse to the longitudinal extension of the mandrel or in two such directions, which can be oriented perpendicular to one another.

In order to allow the package lugs of a gable of the package to be folded in towards the sleeve of the package simply and reliably, so that they can be joined, in particular sealed, together with the sleeve there, a gable pre-folding device can be provided. The form of the top of the package is thereby referred to as the gable. The gable pre-folding device thus serves the purpose of prefolding the gable in order to form the gable of the package. The gable pre-folding device comprises two stamps for pressing together a filled and closed package adjacent to the package lugs of the package gable. Here, adjacent to the package lugs means in particular directly below the package lugs. Fold lines on the package along which the package lugs are folded towards the sleeve of the package are thereby at least partially folded. The stamps can thus preferably compress the package immediately below the corresponding fold lines. Alternatively or additionally, it is particularly preferable if the stamps press against the sleeve of the package from opposite sides of the package. Naturally, tongs or similar can also be used instead of the stamps. In this case the stamps, as understood in the present case, are formed by the tongs or similar.

Irrespective of the design of the mandrel, in order to give the already filled and closed package its final form, it is expedient to press this in a moulding device comprising an at least two-part mould, which can also be referred to as a package crimper. The mould is thereby intended to compress at least partial regions of the sleeve of the package. The at least two mould halves therefore preferably or at least substantially close transversely to the longitudinal extension of the package, which runs from the base of the package to the top of the package. It has thereby proved particularly effective if the sleeve of the package is compressed at least substantially circumferentially.

When reference is made in the present case to a longitudinal direction in relation to the package sleeve, the package body or the package, this is understood to refer to a direction oriented at least substantially parallel to the package sleeve, to the sealing seam of the package sleeve and/or to the sleeve of the package body or the package. In this direction, the corresponding extension of the package sleeve, of the package body and the package is typically greater than in a direction transverse to this direction. However, this need not be the case in exceptional cases, for example in the case of the formation of very low and at the same time very wide packages. However, in order to facilitate understanding and in order to avoid unnecessary repetition, in this case too the longitudinal direction is to be understood as the direction described above, even if this may appear incorrect in the individual case in question. In the present case, therefore, the top and the base of a package are always located at the longitudinal ends of the package, as a result of which the longitudinal direction of the package, of the package body and of the package sleeve is defined.

The assemblies of the device described above as well as the method steps carried out by means of the corresponding assemblies can if necessary in each case be considered as an invention independently of one another and independently of the features described in the independent claims, in each case separately or together with further assemblies or further method steps. This means for example that the present description relates to a series different inventions, of which only one invention has been claimed in the present case. The other inventions are thereby partially but not exclusively described in the dependent claims. The features of the dependent claims and/or features in the description can also if necessary describe further inventions without that these at the same time being described by the independent claims or other dependent claims.

Consequently, exemplary embodiments or inventions are also described which get by without the step of providing package sleeves in a stack which are folded flat along at least two folded edges running in the longitudinal direction of the package sleeve, without the step of the successive removal of the package sleeves from the stack and the transfer of the package sleeves to a forming station, without the step of unfolding in the forming station and/or without the step of pushing the package sleeves unfolded in the forming station onto a mandrel. Analogously, embodiments or inventions are described which get by without a magazine with a package stack of package sleeves which are folded flat along at least two folded edges running in the longitudinal direction of the package sleeve, without a transfer device for transferring the package sleeves in succession from the package stack to a forming station for unfolding the package sleeve and/or without a placement device for pushing the package sleeves unfolded in the forming station onto a mandrel.

In particular, each of the assemblies described herein and/or each of the features described herein can also form the subject matter of a further invention independently of other assemblies or features. Analogously, each of the described method steps can in itself form the subject matter of a further invention. However, neither rules out the possibility that the corresponding inventions can if necessary be combined with further constructive and/or method features, in particular in order to describe in each case preferred exemplary embodiments.

Accordingly, instead of or in addition to at least individual steps of the claimed method and device features, other method features or device features can be combined in order to define or describe a further invention described herein. For example, a separate invention can relate to the prefolding device, the unfolding device, the forming station, the mandrel, the mandrel wheel, the gable pre-folding device, the moulding device, the filling machine and/or other assemblies. Moreover, the separate invention can relate to method steps for operating the corresponding aforementioned assemblies, in each case individually or in combination.

BRIEF DESCRIPTION OF THE DRAWINGS

In the following, the inventions disclosed in the present case are explained in more detail with reference to a drawing which simply illustrates an exemplary embodiment, wherein.

DESCRIPTION OF THE INVENTION

Figure 1A:
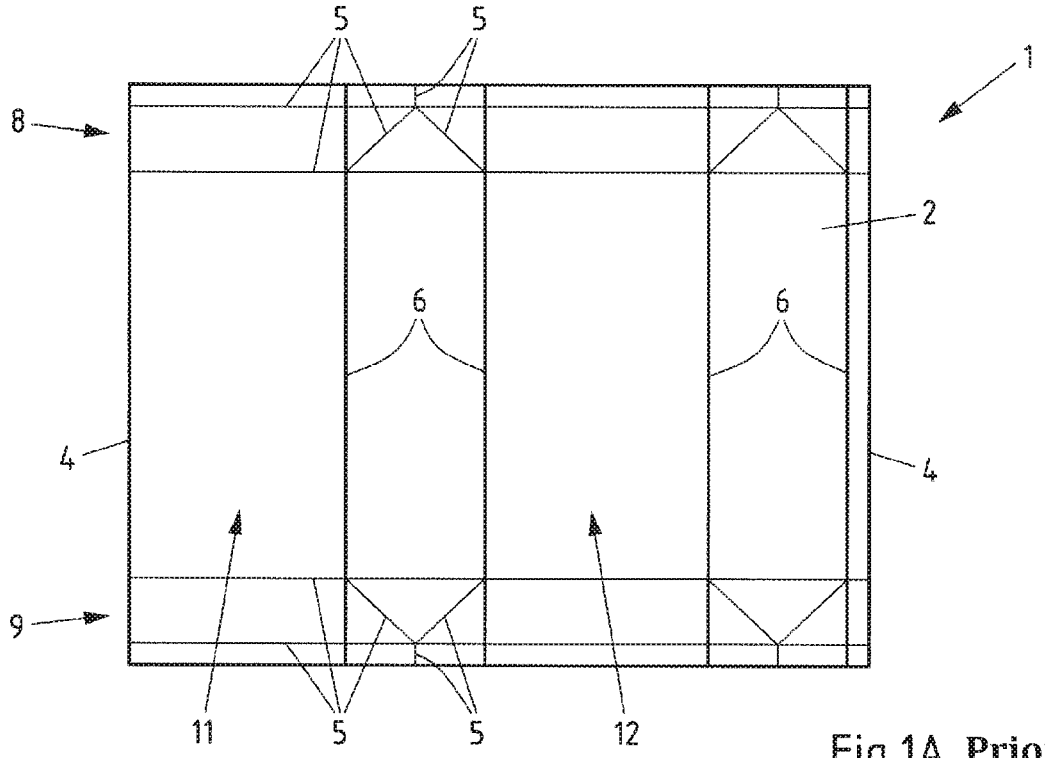
Fig.1A Prior Art
FIG. 1A-B shows a sleeve blank made of a package material and a package sleeve formed from the sleeve blank, known from the prior art, in each case viewed from above.

FIG. 1A illustrates a sleeve blank 1 made of a package material 2 as known from the prior art. The package material 2 is formed as a laminate consisting of several material layers arranged on top of one another. It is in particular a paperboard/plastic composite material. The illustrated package material 2 has two outer layers made of a thermoplastic plastic, preferably polyethylene (PE), which makes possible a sealing, i.e. a welding, of the outer layers of the package material 2. Arranged between these is a paperboard layer, providing structure, with a comparatively high bending stiffness for the package material 2. Moreover, at least one barrier layer can also be provided which is preferably formed of aluminium, polyamide and/or an ethylene vinyl alcohol. Further layers are also conceivable.

The sleeve blank 1 is used to manufacture a package sleeve 3, which is formed in that the outer longitudinal margins 4 of the sleeve blank 1 lying opposite one another are bent over towards one another and joined with one another, in particular sealed to one another. The sleeve blank 1 has a series of fold lines 5,6 along which the sleeve blank 1 can be folded in order to form the desired package 7. The fold lines 5,6, if necessary crease lines, facilitate folding and also ensure reliable folding. Most of the fold lines 5,6 are provided at the upper margin 8 and the lower margin 9 of the sleeve blank 1, which are later folded in order to form the bases and the top or the gable of the package 7. The sleeve blank 1 also has four substantially parallel fold lines 6 along which the sleeve blank 1 is prefolded before forming the package sleeve 3 or thereafter. Once the package material 2 has been bent over once along the fold lines 5,6, a further folding of the package material 2 at the same point only meets a slight resistance that is in any case significantly less than along fold lines 5,6 which have not yet previously been folded.

Figure 1B:
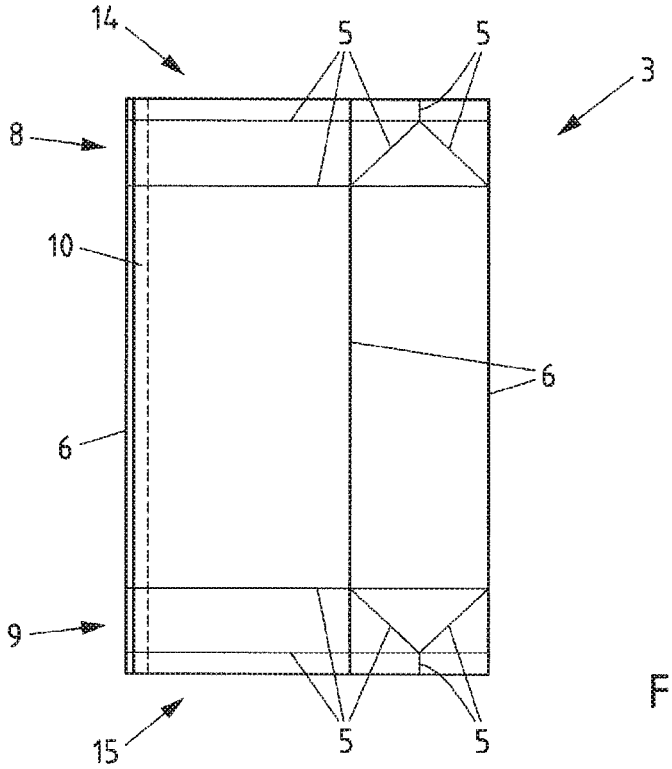
Fig.1B Prior Art

FIG. 1B shows the package sleeve 3 after the longitudinal margins 4 of the sleeve blank 1 have been sealed together. For optical reasons, the corresponding sealing seam 10 is thereby positioned near one of the fold lines 6 of the package sleeve 3. The package sleeve 3 has folded edges 6 on its longitudinal edges along which the package sleeve 3 has been folded flat, so that the front portion 11 and the rear portion 12 of the package sleeve 3 lie on top of one another. The package sleeve 3 can be stored easily when folded flat in this way. Nonetheless, it can subsequently be easily unfolded along the four prefolded fold lines 6. A package sleeve 3 with a rectangular cross section is then obtained.

Figure 2:
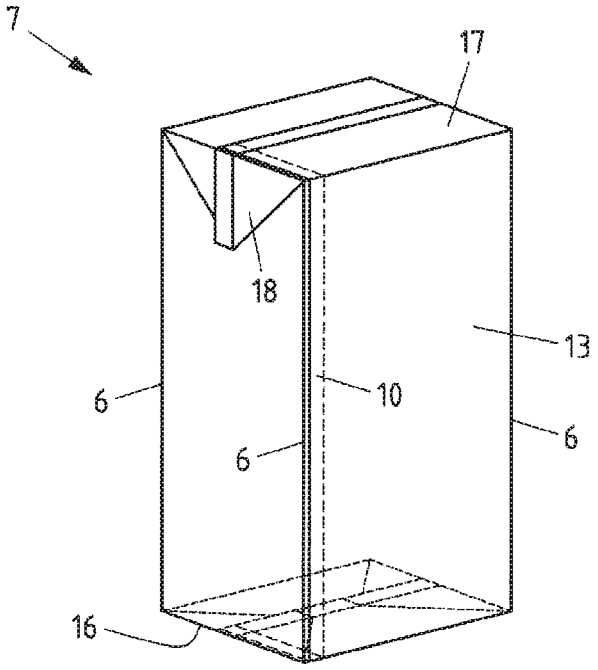
Fig.2 Prior Art
FIG. 2 shows a package, known from the prior art, formed from the package sleeve according to FIG. 1B in a perspective view.

In the following, the package 7 illustrated in FIG. 2 can be obtained using the corresponding package sleeve 3. In the case of the package 7, the four prefolded fold lines 6 in the region of the sleeve 13 of the package 7 then form the edges of the package 7, as the prefolded fold lines 6 previously formed the edges of the package sleeve 3. The longitudinal ends 14,15 of the package sleeve 3 have been folded and sealed in order to form the base 16 of the package 7 and in order to form the top 17 of the package 7. So-called package lugs 18 are thereby formed at the top 17 of the package which are folded downwards and laid against the sleeve 13 of the package 7 and sealed or glued in place there. In the case of the base 16, the corresponding package lugs are folded into this and are therefore no longer visible as such following formation of the base 16.

Figure 3:
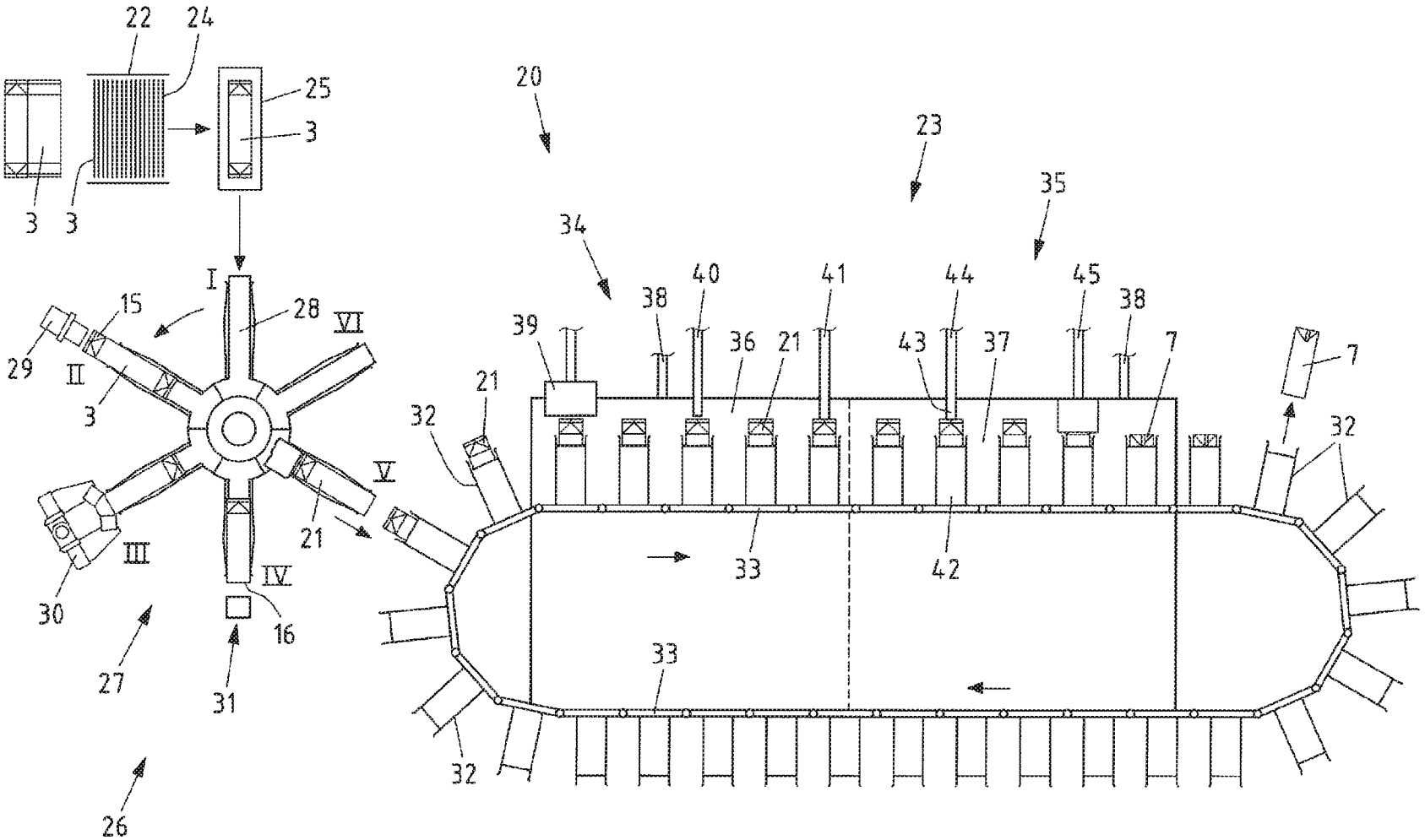
Fig.3 Prior Art
FIG. 3 shows a device for manufacturing the package according to FIG. 2 from a package sleeve according to FIG. 1B from the prior art in a schematic representation.

FIG. 3 shows a device 20 for filling package bodies 21, in particular with flowable foodstuffs, in order to form packages 7, that is to say a so-called filling machine, comprising a magazine 22 for the supply of package sleeves 3 and a device for forming package bodies 21 from the package sleeves 3, which are closed at one end and can thus receive for example a flowable foodstuff through the remaining opening. The illustrated and as such preferred device 20 has a series of parallel processing lines, of which only one processing line 23 is illustrated in FIG. 3. Each processing line 23 is assigned a magazine 22 with a stack 24 or bundle of package sleeves 3 which have been folded flat along two of the fold lines 6. The package sleeves 3 have, as described above, been formed from sleeve blanks 1, made of a package material 2, the longitudinal margins 4 of which are sealed to one another. The package sleeves 3 are unfolded by means of a feed device 25. The unfolding of the package sleeves 3 is thereby achieved by pulling a later side surface of the corresponding package sleeve 3 away from the stack 24, without further action, along the prefolded fold lines 6 which form the edges of the package sleeve 3 and the later package 7. If necessary, an application device for applying pourer inserts, not illustrated, to the package sleeve 3 can also be provided.

The device 26 for forming the package 7 has a mandrel wheel 27 which in the illustrated and as such preferred case comprises six mandrels 28 and rotates cyclically, that is to say stepwise, in an anticlockwise direction. In the first mandrel wheel position I, a package sleeve 3 is pushed onto the mandrel 28. The mandrel wheel 27 is then rotated further into the next mandrel wheel position II, in which the longitudinal end 15 of the package sleeve 3 projecting in relation to the mandrel 28 is heated with hot air by means of a heating unit 29. In the next mandrel wheel position III, the heated longitudinal end 15 of the package sleeve 3 is prefolded by means of a press 30 and in the following mandrel wheel position IV is sealed closed in the folded position by means of a sealing device 31, in particular to form a base 16.

In this way, a package body 21 closed at one end is obtained which, in the following mandrel wheel position V, is removed from the mandrel 28 and transferred to a cell 32 of a transport device 33 which moves in an endless circle. In the next mandrel wheel position VI, the mandrel 28 is not assigned any working step. The number of mandrel wheel positions or mandrels 28 and the processing steps provided there can if necessary differ from the representation according to FIG. 1 and the associated description. Moreover, in at least one if necessary further mandrel wheel position, a pourer insert can also be joined with the package material. In this case, the longitudinal end of the package sleeve which is closed on the mandrel wheel is preferably the top of the later package. Whether the package body is filled through the later top or through the later base only plays a secondary role in the present case.

The package body 21 removed from the mandrel wheel is transported through a filling machine 34 in the associated cell 32, in particular of a chain of cells, with the open longitudinal end pointing upwards. The package body thereby enters an aseptic chamber 35, which comprises a sterilisation zone 36 and a filling and sealing zone 37, through which the package bodies 21 are transported from left to right in the direction of transport symbolised by the arrow. The transport of the package bodies 21 need not take place in a straight line, but can also take place at least in an arc or even in a circle.

The aseptic chamber 35 is supplied with sterile air via corresponding sterile air connections 38. The package bodies 21 are preheated by having hot sterile air being blown on them in succession by a pre-heating device 39. The package bodies 21 are then sterilised by means of a stabilising device 40, preferably by means of hydrogen peroxide, whereupon the package bodies 21 are dried by being blown on with sterile air by a drying device 41 and, after passing from the sterilisation zone 36 into the filling and sealing zone 37, are brought into a filling position 42 beneath a filling outlet 43. Here, the package bodies 2 are filled in succession with foodstuffs 44. The filled package bodies 21 are then closed by means of a closing device 45 by folding the upper regions of the package body 21 and sealing. The filled and closed packages 7 are then removed from the cells 32 of the transport device 33. The now empty cells 32 are moved on by the transport device 33 in the direction of the mandrel wheel 27 in order to receive further package bodies 21 there.

Figure 4A:
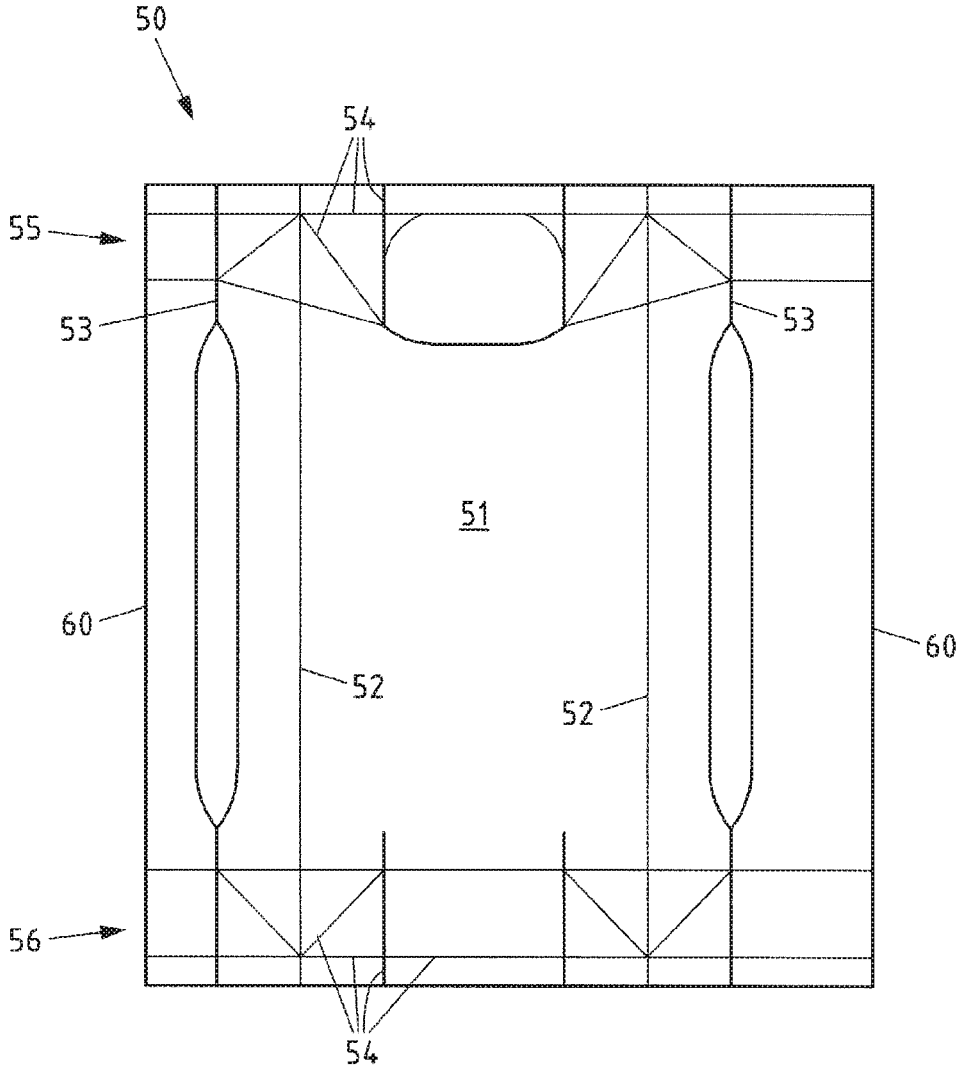
FIG. 4A-C shows a sleeve blank made of a package material and a package sleeve formed from the sleeve blank, viewed from above.

FIG. 4A shows a further sleeve blank 50 made of a package material 51 which is fundamentally similar to the sleeve blank 50 shown in FIG. 1A in terms of the package material 51, the sleeve blank 50 and the fold lines 52,53,54. However, the difference is that the fold lines 52,53,54, in particular crease lines, are arranged and formed differently. For example, in particular, only two fold lines 52 are provided which extend in a straight line in a longitudinal direction and over the entire longitudinal extension of the sleeve blank 50. Two further fold lines 53 are divided into sections in the longitudinal direction of the sleeve blank 50 and enclose a portion of the sleeve blank. In the corresponding region, the fold lines 53 run parallel to one another, which is not however essential. The upper margin 55 and the lower margin 56 of the sleeve blank 50 are also provided with fold lines 54. The fold lines 54 of the lower margin 56 serve to form a base 57, while the fold lines 54 of the upper margin 55 serve to form a top 58 of a package 59.

Figure 4B:
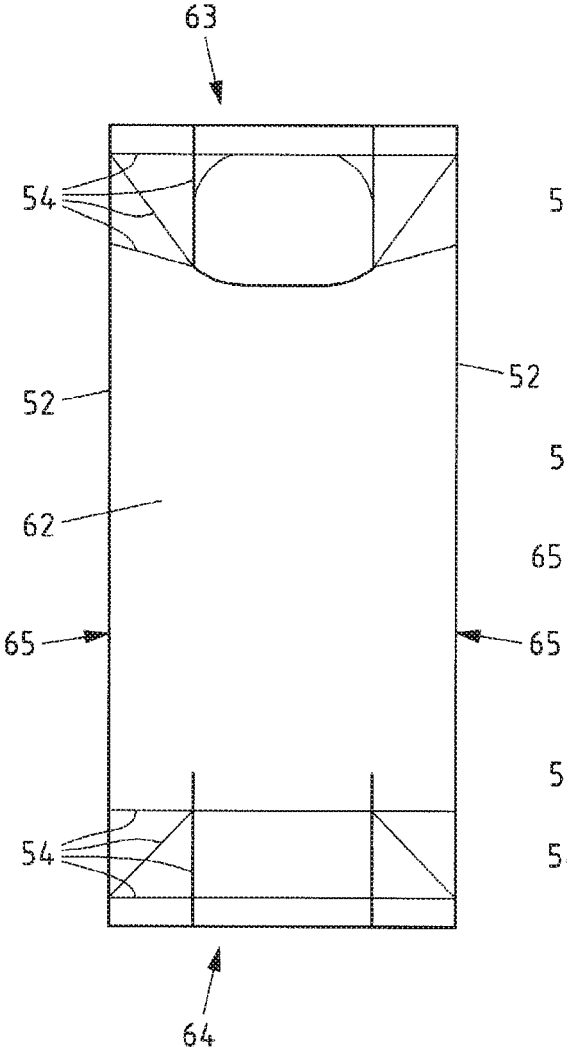
Figure 4C:
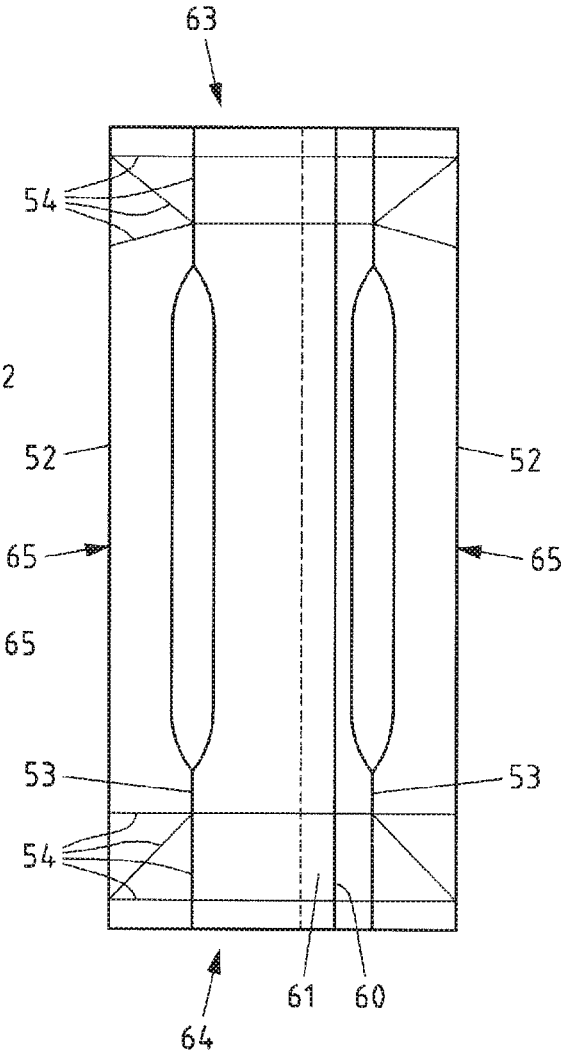

The sleeve blank 50 is sealed along the longitudinal edges 60, forming a sealing seam 61, in order to form a package sleeve 63, the front side 64 and rear side 64' of which are illustrated in FIG. 4B-C. The package sleeve 62 is folded along the two fold lines 52 running in a straight line in the longitudinal direction of the package sleeve 62 to form the folded edges 65, so that the front side 64 and the rear side 64' of the package sleeve 62 lie on top of one another.

Figure 5:
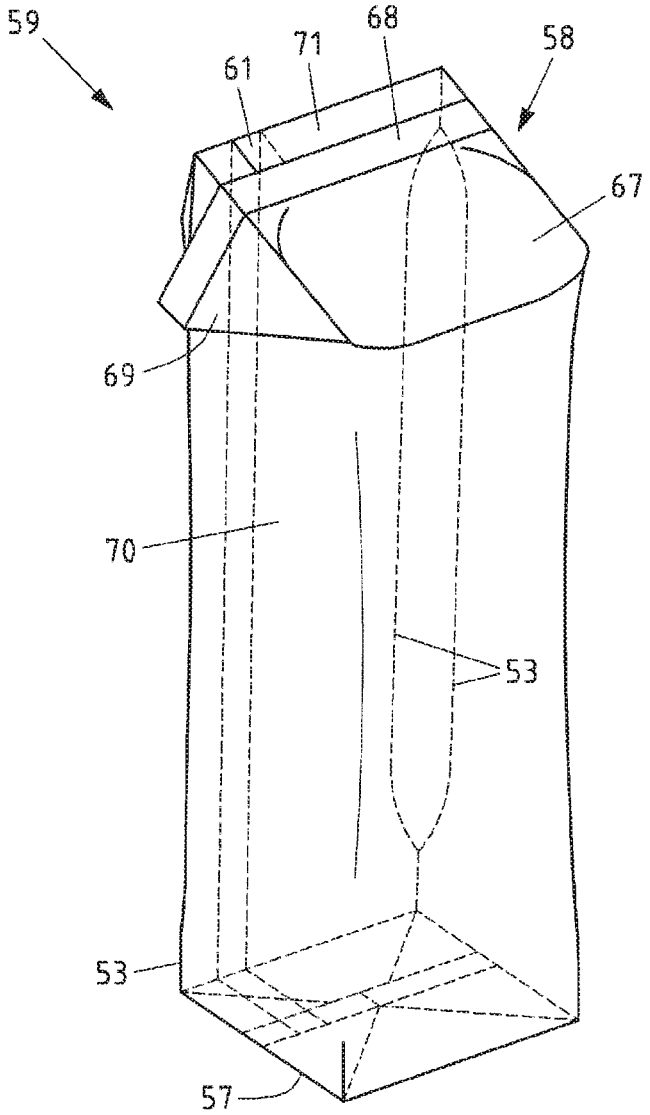
FIG. 5 shows a package formed from the package sleeve according to FIG. 4B-C package in a perspective view.

The package 59 illustrated in FIG. 5 can be formed using the corresponding package sleeve 63. The package 59 has a flat base 57 which is oriented perpendicular to the longitudinal extension of the package 59. The top 58 of the package 59 is in contrast oriented obliquely to the longitudinal extension of the package 59 and so forms a package gable 66. The package gable 66 thereby has a larger front gable surface 67 which is larger than the smaller rear gable surface 71 arranged on the other side of the sealing seam 68. The sealing seam 68 and adjacent portions of the top 58 form package lugs 69 on opposite sides of the package 59 which are folded downwards and laid against and sealed onto the sleeve 70 the package 59. If necessary, a large opening section, a large weakening and/or a large pourer can be provided on the large gable surface 67. For the sake of simplicity, neither an opening section nor a weakening nor a pourer is illustrated. A notable feature of the package 59 is that no continuous fold lines 52 or folded edges 65 are provided on the front longitudinal margins of the package 59. Another special feature of the package 59 is that the folded edges 65 used to fold the package sleeve 63 flat are not provided on any longitudinal margin of the package 59. Instead, the folded edges 65 are positioned in the areas between the longitudinal margins or longitudinal edges of the package. In other words, the folded edges 65 of the package sleeve 63 are folded back again and thus no longer form folded edges of the package 59. Moreover, no fold lines 52,53,54 are provided on the rear edges of the sleeve 70 of the package 59 which extend in a straight line in the longitudinal direction of the package. The division of the fold lines 53 means that these do not run in a straight line over the entire longitudinal extension of the sleeve 70 of the package 59 and also, at least in sections, not along the edges of the sleeve 70 of the package 59, but in areas next to these.

Figure 6:
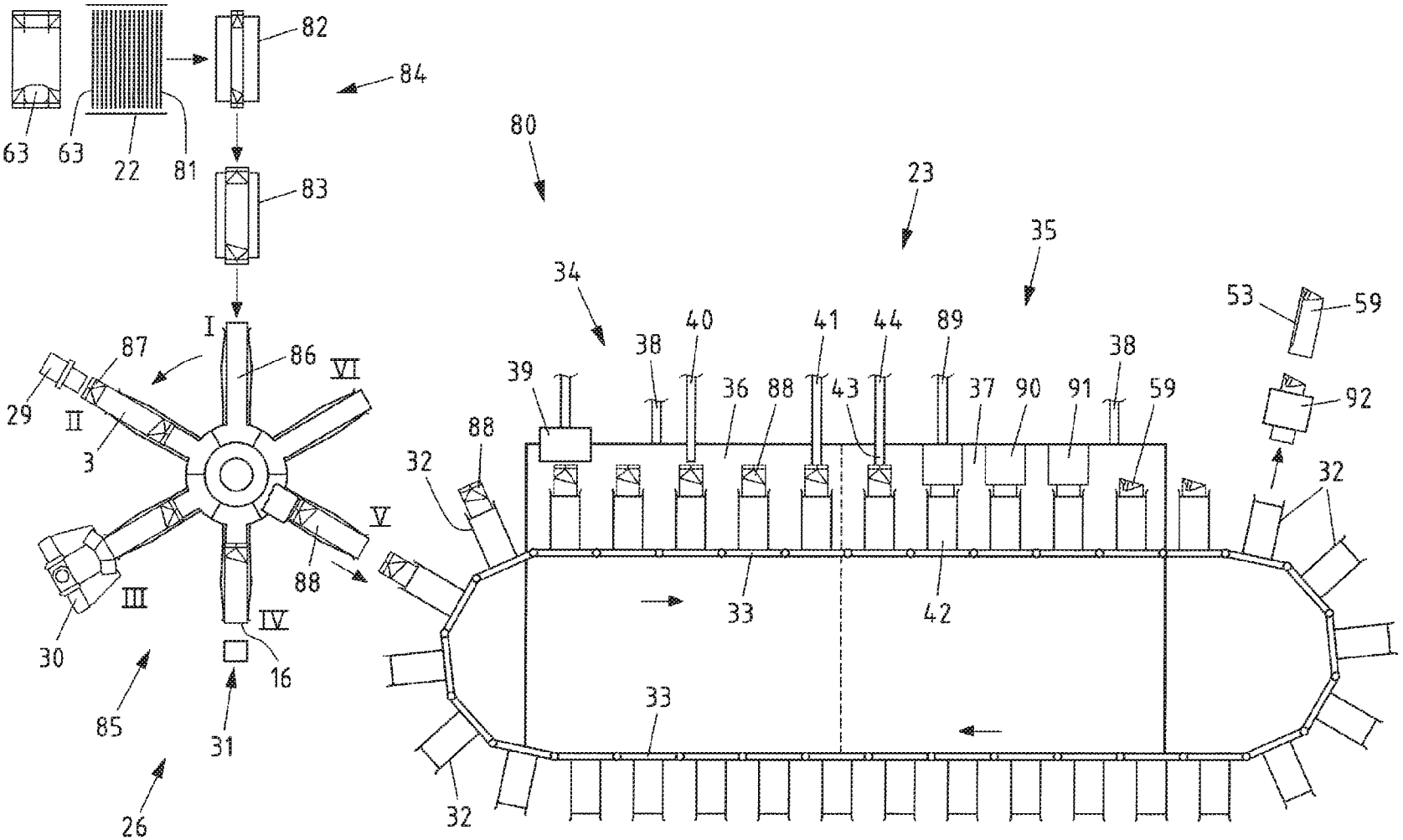
FIG. 6 shows a device for manufacturing the package according to FIG. 5 from a package sleeve according to FIG. 4B-C in a schematic representation.

FIG. 6 illustrates the device 80 for filling such packages 59. The device 80 thereby largely corresponds to the device 20 illustrated in FIG. 3, so that in order to avoid unnecessary repetition it is essentially the differences in the device 80 illustrated in FIG. 6 in comparison with the device 20 illustrated in FIG. 3 illustrated device 20 which are described in the following. For this reason, identical components in FIGS. 3 and 6 are identified with the same reference numbers.

One difference for example is that the package sleeves 63 are provided in the magazine 22 of the device 80 illustrated in FIG. 4B-C in the form of the stack 81, i.e. they are only prefolded along two fold lines 52 extending in a straight line over the entire longitudinal extension of the package sleeve, whereby these fold lines 52 form the folded edges 65 of the package sleeve 63 along which the package sleeves 63 are folded flat. Also, in the device 80 illustrated in FIG. 6, in supplementation of the device 20 illustrated in FIG. 3, a prefolding device 82 for prefolding the package sleeve 63 following removal of the package sleeves 63 from the stack 81 of package sleeves 63 and an unfolding device 83 for unfolding the package sleeves 63 which have been removed from the stack 81 of package sleeves 63 in the magazine 22 are provided. In the illustrated and as such preferred device 80, the prefolding device 82 and the unfolding device 83 are combined into a forming station 84 for forming the unfolded package sleeves 63 which are to be transferred to the mandrel wheel 85. Also however, only the prefolding device 82 or only the unfolding device 83 could be provided. Only after passing through the forming station 84 are the package sleeves 63 pushed onto the mandrels 86. The mandrels 86 are thus formed differently from the mandrels 28 illustrated in FIG. 3. The mandrels 86 can be spread, i.e. adjusted from a narrow starting position into a wider pressing position, wherein in the pressing position of the mandrel 86 a pressing surface is provided against which the corresponding longitudinal end 87 of the package sleeve 63 can be folded and pressed in order to close the longitudinal end 87, in particular to seal this in a liquid-tight manner. In this way, package bodies 88 are finally formed which are transferred into the cells 32 of the transport device 33, in this case in the form of a chain of cells.

Furthermore, in the device 80 illustrated in FIG. 6, in comparison with the device 20 illustrated in FIG. 3, a gable pre-folding device 90 for prefolding the package gable 66 and a sealing device 91 for sealing the package lugs 69 to the sleeve 70 of the package 59 are provided after a sealing 6 device 89 for sealing the sealing seam 68 of the package gable 66. Moreover, in the illustrated and as such preferred device 80, a moulding device 92 for final forming of the filled and closed package 59 is provided. In this moulding device 92, the package 59 is given its final form. For the sake of clarity, the moulding device 92 is illustrated such that the package 59 projects at the top and bottom in relation to the moulding device 92. Preferably, however, the package 59 is received into the moulding device 92 over its entire longitudinal extension.

Figure 7:
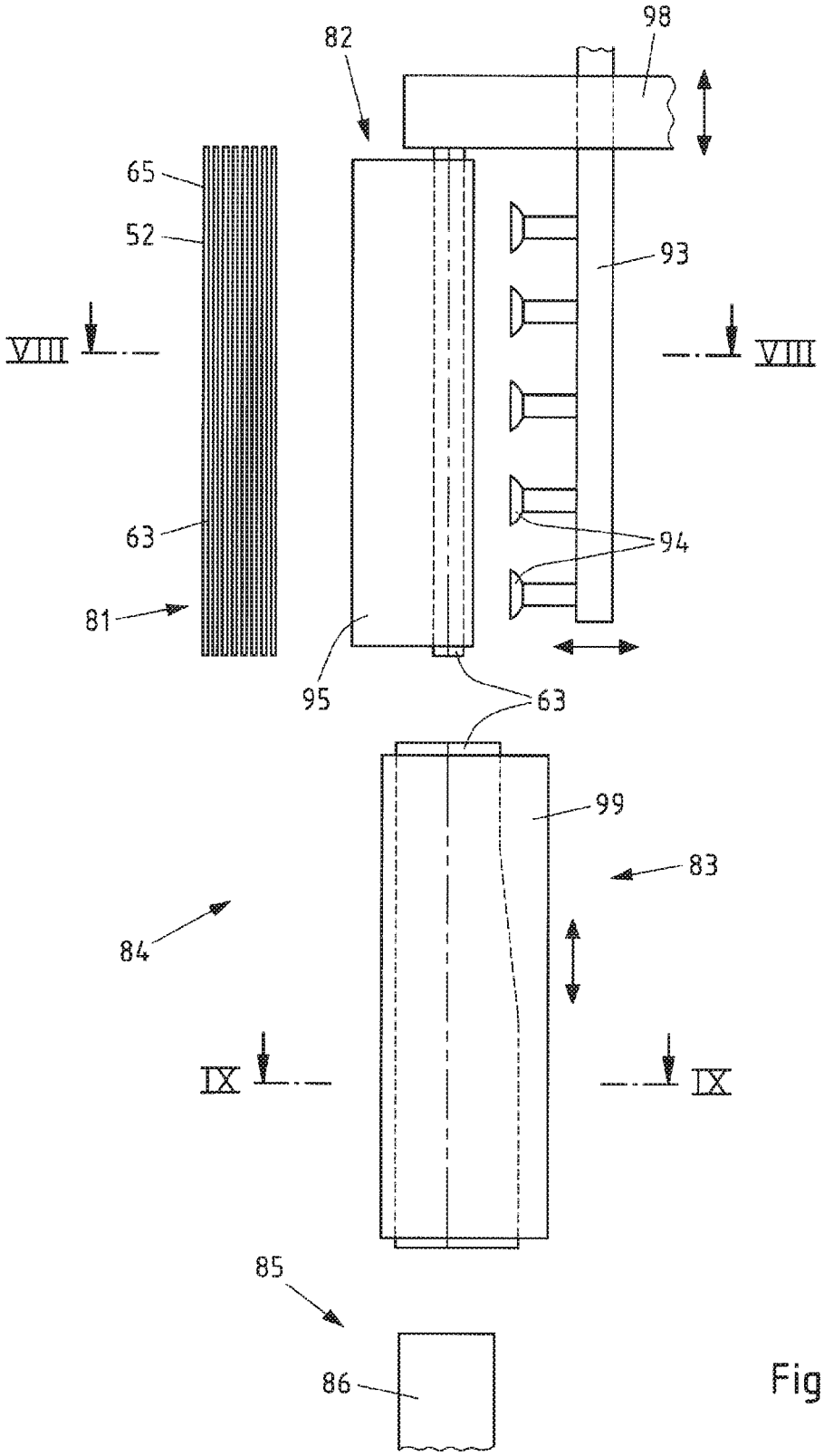
FIG. 7 shows the unfolding of the package sleeve in a forming station in a schematic side view.
Figure 8:
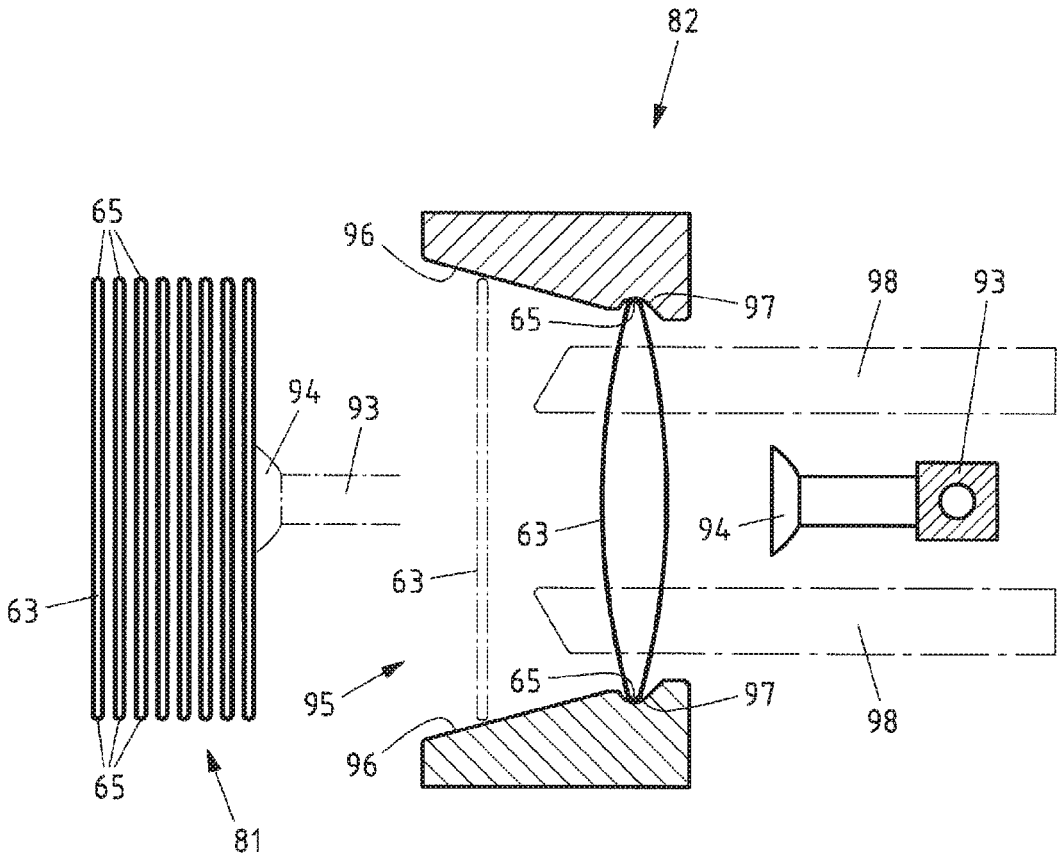
FIG. 8 shows the prefolding of the package sleeve in a sectional view through the sectional plane VIII-VIII from FIG. 7.

The forming station 84 of the device 80 illustrated in FIG. 6 is illustrated schematically in FIG. 7. The forming station 84 uses the package sleeves 63 which are supplied, folded together along two fold lines 52 or folded edges 65, in a stack 81 of package sleeves 63 held in a magazine 22. The forming station 84 thereby comprises a gripper arm 93 with suction cups 94 which grabs the front side of the flat-folded package sleeve 63 at the front of the stack 81 and draws the package sleeve 63 into and through a channel 95 of the prefolding device 82. The prefolding device 82 is in particular illustrated in the sectional view of the forming station 84 according to FIG. 8 The gripper arm 93 is shown, in broken lines, picking a package sleeve 63 from the stack 81. The gripper arm 93 then moves together with the package sleeve 63 in a straight line backwards and draws the package sleeve 63 in a straight line into a channel 95 narrowing transversely to the package sleeve 63. In the channel 95, the folded edges 65, along which the package sleeve 63 has been folded flat, come into contact with the boundaries 96 of the channel 95. Finally, the folded edges 65 press from the inside against the channel 95 which, in response, opens up the package sleeve 63 somewhat, increasingly wider as the package sleeve 63 is drawn or transported further through the channel 95. At the rear end of the channel 95, grooves 97 oriented in the longitudinal direction of the folded edges 65 are provided on two sides of the channel 95 into which the package sleeve 63 engages with the folded edges 65, in the corresponding position. The suction cups 94 and thus the gripper arm 93 then release the package sleeve 63. The package sleeve 63 remains within the channel 95, held within the grooves 97.

Figure 9A:
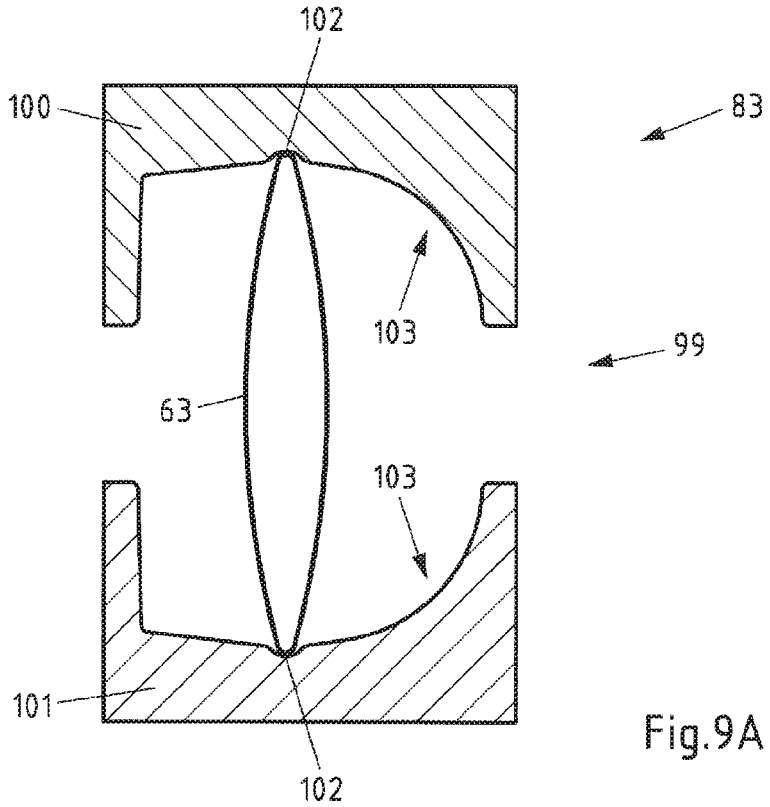
FIG. 9A-B shows the forming of the package sleeve in a sectional view through the sectional plane IX-IX from FIG. 7.
Figure 9B:
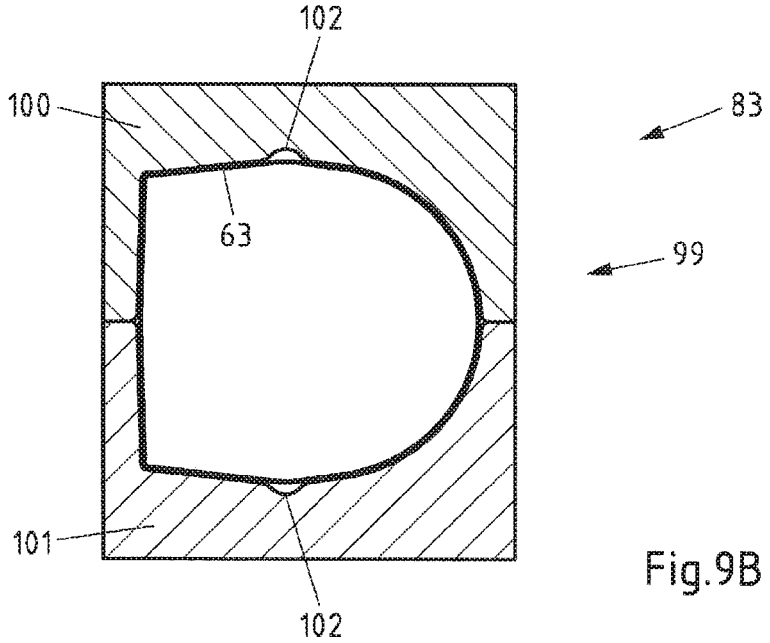

Two fingers 98 are arranged above the package sleeve 63 positioned in this way, as illustrated in particular in FIG. 7. These fingers 98 now move downwards and press the package sleeve 63 downwards into a mould 99 of the unfolding device 83 in order to unfold the package sleeve 63. The mould 99 of the unfolding device 83 is in particular illustrated in cross section in FIG. 9A-B. In FIG. 9A, the mould 9 is illustrated by way of example with two mould halves 100,101 in an opened position. The prefolded package sleeve 63 is received in this position by the mould 99, for which purpose grooves 102 are also provided in the illustrated and as such preferred mould 99, into which the folded edges 65 of the package sleeve 63 engage. The mould 99 is then closed and ends up in the closed position illustrated by way of example in FIG. 9B. The package sleeve 63 is unfolded and lies at least substantially against the inner contour 103 of the mould 99. In this way, the package sleeve 63 can be brought at least approximately into the later form of the package 59. Instead of the illustrated form of the contour, if necessary contours of a different form can be provided, depending on the form in which the packages are to be manufactured. In FIG. 7 it is indicated, through the double arrow and the mandrel 86 of a mandrel wheel 85 positioned beneath the mould 99, that after closing the mould 99 moves downwards over the mandrel 86 and transfers the unfolded package sleeve 63 to the mandrel 86 or pushes it onto the mandrel 86.

Figure 10A:
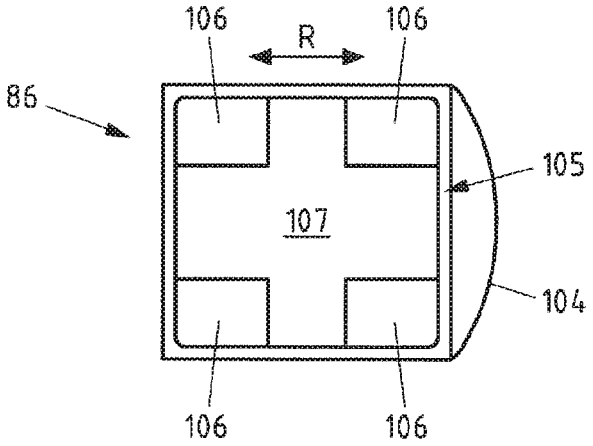
FIG. 10A-B shows the mandrel onto which the formed package sleeve is pushed in a schematic top view.
Figure 10B:
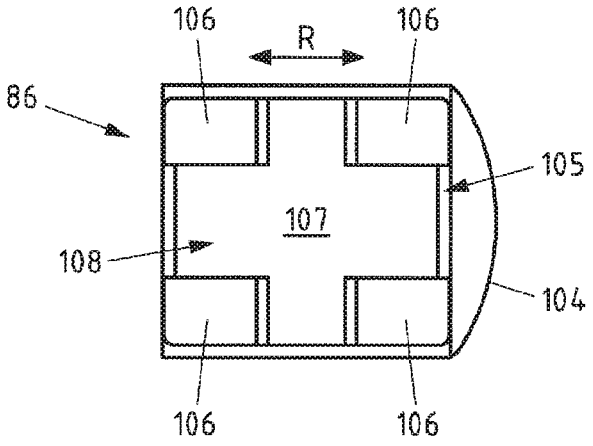

FIG. 10A-B shows in schematic form a top view of the mandrel 86 of the mandrel wheel 85. In FIG. 10A, the mandrel 86 is in a starting position in which package sleeves 63 can be simply pushed onto the mandrel 86 and removed again. In some sections, the mandrel 86 does not have a rectangular or square cross section. In the illustrated and as such preferred mandrel 86, one side of the sleeve 104 bulges outwards. Movable mandrel elements 106 and a static mandrel element 107 located between them are provided at the top 105 of the illustrated and as such preferred mandrel 86. In the starting position, the movable mandrel elements 106 assume an inner position. The mandrel 86 is therefore narrower in a direction R than in the pressing position of the mandrel 86 illustrated in FIG. 10B, in which the movable mandrel elements 106 are moved outwards. The mandrel 86 is spread wider in this position and can be used to press a longitudinal end 87 of the package sleeve 63 against the mandrel 86. In the pressing position, the upper side of the top 105 of the mandrel 86 forms a pressing surface 108 for pressing the folded-together longitudinal ends 87 of the package sleeve 63. The corresponding longitudinal end 87 of the package sleeve 63 can thereby be closed, if necessary through sealing.

Figure 11:
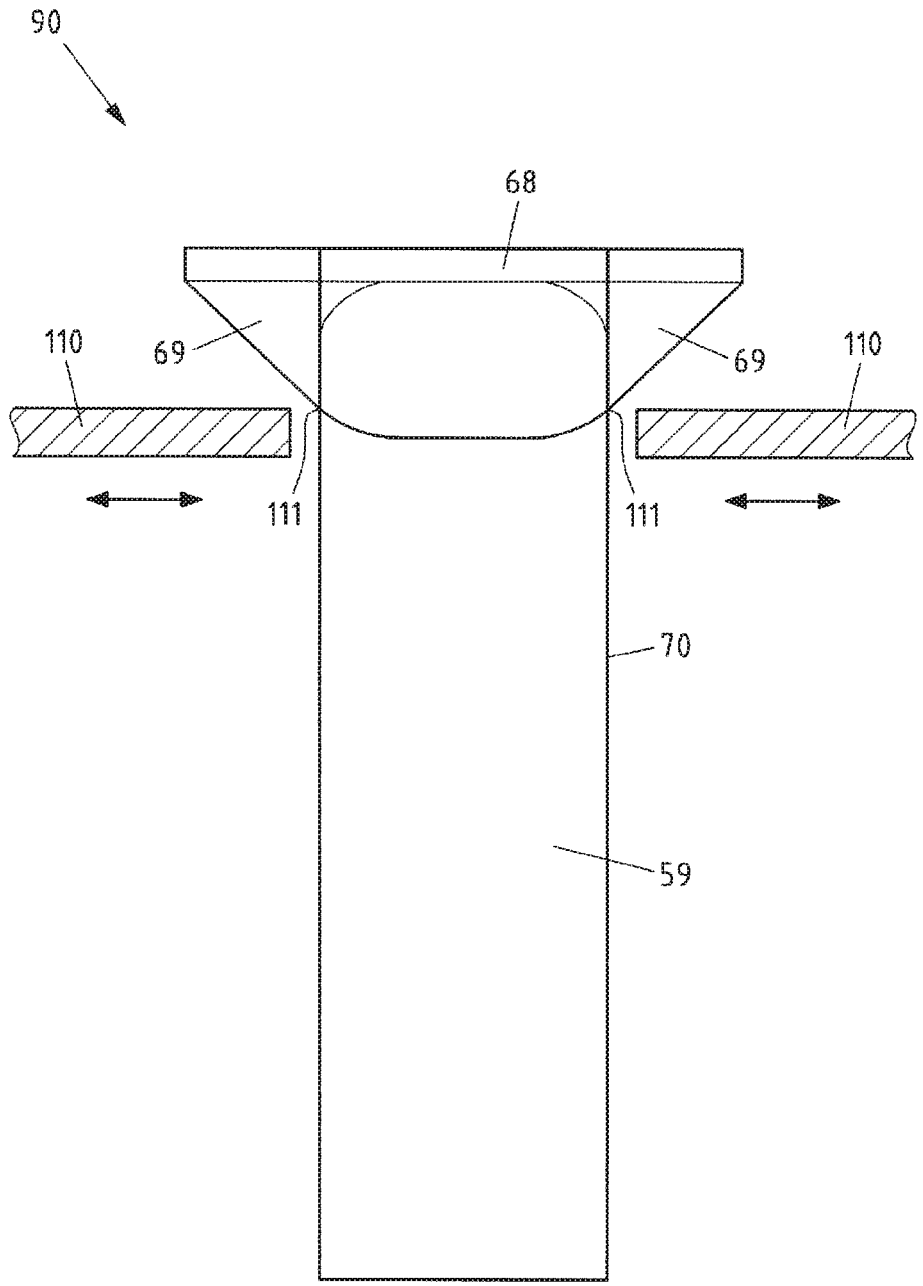
FIG. 11 shows the pre-forming of the package gable of the filled and closed package in a schematic representation and FIG. 12A-B shows the forming of the filled and closed package in a schematic representation.

FIG. 11 illustrates in schematic form a gable pre-folding device 90 for prefolding the package gable 66, wherein a package 59 which has been filled and closed along the sealing seam 68 of the package gable 66 is positioned in the gable pre-folding device 90 with package lugs 69 projecting outwards relative to the sleeve 70 of the package. Two stamps 110 are being pressed from opposite sides of the package 59 against the sleeve 70 of the package 59 so that the sleeve 70 of the package 59 is pressed in at the corresponding point. The stamps 110 are thereby applied below the projecting package lugs 69. The package 59 is thereby partially folded along opposite fold lines 111 below the package lugs 69. After the stamps 110 are moved away again from the package 59, the package lugs 69 can be bent down in a defined way along the correspondingly prefolded fold lines 111 and fixed in place against the sleeve 70 of the package 59.

Figure 12A:
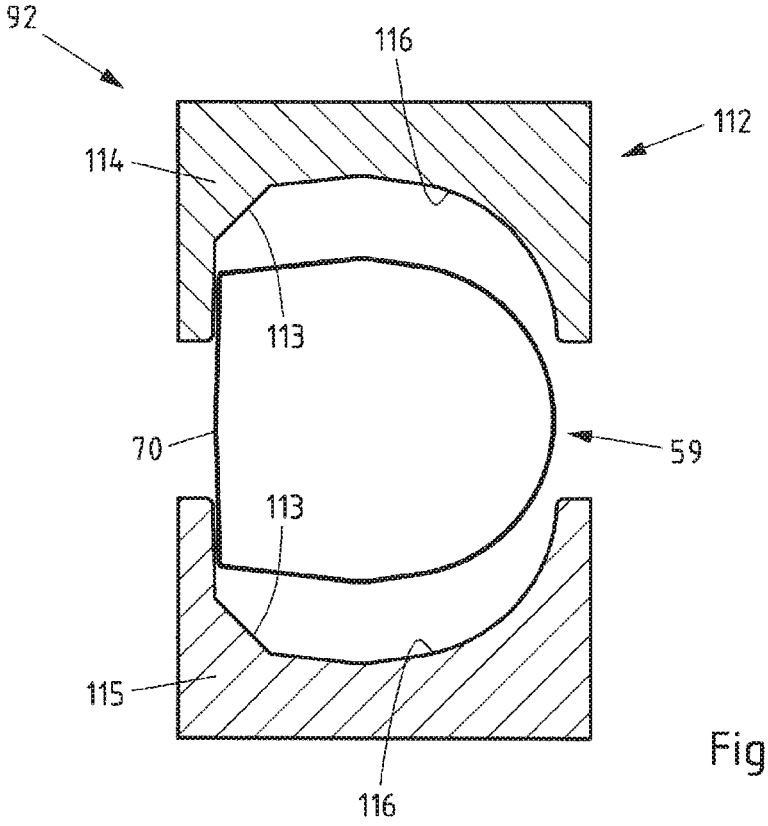
Figure 12B:
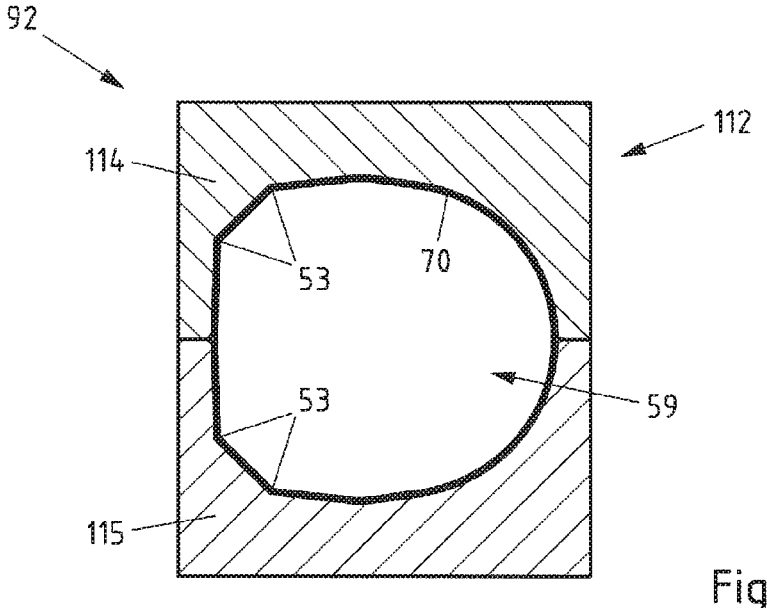

FIG. 12A-B shows a moulding device 92 for forming the filled and closed package 59 in which the package lugs 69 are preferably already fixed to the sleeve 70 of the package 59.

The package 59 is introduced into the opened mould 112 of a package crimper comprising at least two mould halves 114,115. The mould 112 is then closed for and the package 59 is thereby pressed or squeezed from outside. The mould 112 can preferably receive the package 59 over its entire longitudinal extension and/or overlap it at the top and bottom in order for example, in the closed state of the mould 112, to hold, in particular to press the package 59, not only around the entire circumference of the package 59, but also all around the longitudinal extension of the package 59.

In the illustrated and as such preferred mould 112, the inner contour 116 of the mould 112 corresponds to the desired form of the package 59 but not the form of the fed package 59. The contour 116 is not restricted to the form illustrated in FIG. 12A-B. Differently formed contours can be provided in order to produce differently formed packages. In the present case, the mould 112 has bevelled edges 113 which the package 59 is also supposed to possess. When closing the mould 112 the package 59 is pressed at least substantially circumferentially against the inner contour 116 of the mould 112 and thereby folded or bent in the region of the bevelled edges 113 along already-provided fold lines 53 of the package The region of the package 59 between the dividing fold lines 53 is thus brought into an oblique alignment relative to the sides and to the rear of the package 59 in order to impress the desired edge form. The impressed edge form is also retained following removal of the package 59 from the mould 112, since the edge form has already been defined in the package 59 as a result of the fold lines 53. The package material 51 had simply not yet been bent or folded along the fold lines 53.

The invention claimed is:

1. A method for forming package bodies open at one end from package sleeves open at both ends for the manufacture of filled packages, comprising keeping the package sleeves ready for further processing in a stack, folded flat along at least two folded edges running in the longitudinal direction of the package sleeves, transferring at least one flat-folded package sleeve in succession from the stack to a forming station, unfolding the at least one package sleeve in the forming station, drawing the at least one package sleeve through a channel that is in contact with at least two opposite folded edges of the package sleeve and narrows in a transverse direction to the at least one package sleeve, engaging the at least one package sleeve at the end of the channel in grooves arranged in opposite sides of the channel, and pushing the at least one unfolded package sleeve from the forming station onto a mandrel to close or seal, a longitudinal end of the package sleeve.

2. The method according to claim 1, wherein the at least one package sleeve is folded flat along exactly two folded edges and/or no fold line running between the folded edges that extends in a straight line over an entire longitudinal extension of the package sleeve is provided for folding the package sleeves.

3. The method according to claim 1, wherein, in the forming station, in order to enlarge a free cross section of the package sleeve, a pressure is applied from opposite sides of the package sleeve against the at least two folded edges such that the at least two folded edges of the package sleeve are moved towards one another.

4. The method according to claim 1, wherein when unfolding the at least one package sleeve in the forming station, the package sleeve is positioned between at least two mould halves of a mould and the package sleeve is unfolded by closing the mould with the package sleeve lying at least substantially circumferentially against the inside of the mould.

5. The method according to claim 1, wherein a side of the at least one package sleeve forming the front side of the stack is seized and drawn from the stack and/or the package sleeve is in a pre-folding device, drawn through the channel.

6. The method according to claim 5, wherein, as the at least one package sleeve is being drawn through, lateral boundaries of the channel press against the at least two folded edges of the package sleeve such that the folded edges of the package sleeve are moved towards one another.

7. The method according to claim 5, wherein the at least one package sleeve engages with the at least two folded edges at the end of the channel in grooves arranged in opposite sides of the channel and the at least one package sleeve is transported further in a longitudinal direction of the grooves, in the grooves and/or together with the grooves, into an unfolding device.

8. The method according to claim 1, wherein the at least one package sleeve is moved through a pre-folding device and the at least one package sleeve is moved into the unfolding device at least substantially perpendicular to the direction of movement within the pre-folding device.

9. The method according to claim 1, wherein the at least one package sleeve is pushed onto the mandrel with the folded edges spaced at a distance from an edge of a sleeve of the mandrel and/or a corner of a top of the mandrel, and wherein a distance from the folded edge to an adjacent edge and/or a corner of the mandrel amounts to at least a tenth of the distance between the adjacent edges and/or corners.

10. The method according to claim 9, wherein the folded edges are arranged on flat and/or convex sides of a sleeve of the mandrel.

11. The method according to claim 1, wherein, to close the package sleeve, a longitudinal end of the package sleeve is pressed against a pressing surface of the mandrel which is only formed after the at least one package sleeve has been pushed onto the mandrel and after the closing of the at least one package sleeve and before the removal of the at least one package sleeve from the mandrel, the mandrel is returned to the starting position before the at least one package sleeve is pushed on.

12. The method according to claim 11, wherein, for the purpose of closing, a width of a free end of the mandrel is enlarged in at least one direction transverse to the at least one package sleeve and is reduced in order to push on and/or remove the at least one package sleeve.

13. A device for forming package bodies open at one end from package sleeves open at both ends for the manufacture of filled packages, for the manufacture of filled packages according to claim 1, comprising a magazine, a stack comprising at least one package sleeve, a transfer device, a forming station, a placement device, and a mandrel, wherein the at least one package sleeve in the stack is folded flat along at least two folded edges running in the longitudinal direction of the package sleeve, the transfer device transfers the at least one package sleeve from the stack in succession to the forming station for unfolding, the forming station comprising a channel for the partial unfolding of the at least one package sleeve moved through the channel and at the end of the channel, opposing grooves are provided to receive the at least two folded edges of the at least one package sleeve, and the placement device pushes the at least one unfolded package sleeve from the forming station onto the mandrel, wherein a pre-folding device has the channel comprising lateral boundaries for partial unfolding of the package sleeves moved through the channel, the width of the channel narrowing in a transport direction of the package sleeves to a dimension less than the width of the flat-folded package sleeves as they are held in the magazine, such that, as the package sleeves are moved through, the lateral boundaries of the channel press against the at least two folded edges of the package sleeve and move the folded edges of the package sleeve towards one another.

14. The device according to claim 13, wherein the forming station has at least two stamps which simultaneously press together and unfold the at least one package sleeve and, the at least two stamps are designed as at least two mould halves, wherein by closing the mould the at least one package sleeve is unfolded, coming at least substantially circumferentially into contact with the inside of the mould.

15. The device according to claim 13, wherein the lateral boundaries of the channel are fixed in place, at least when the at least one package sleeve moves through the channel.

16. The device according to claim 15, further comprising a feed device to feed the package sleeves to the unfolding device in a longitudinal extension of the grooves in the grooves and/or together with the grooves.

17. The device according to claim 13, wherein the transfer device further comprises a gripper arm and a feed device to move the package sleeve through a pre-folding device in a first direction of transport and into an unfolding device in a second direction of transport oriented substantially perpendicular to the first direction of transport.

18. The device according to claim 13, wherein the mandrel is designed to be adjusted between a wider pressing position and a narrower starting position for pushing on and removing package sleeves, and that in the pressing position the mandrel provides a pressing surface for pressing a longitudinal end of the package sleeve against the mandrel.

19. The device according to claim 13, wherein a gable pre-folding device comprising two stamps is provided to press together a filled and closed package adjacent to at least one package lug of a package gable, at least partially folding a fold line of the package in order to lay the package lugs against the sleeve of the package.

20. The device according to claim 13, wherein an at least two-part mould is provided in order to press the sleeve of the filled and closed package.

* * * * *